US006038968A

United States Patent [19]

Hara et al.

[11] Patent Number: 6,038,968

[45] Date of Patent: Mar. 21, 2000

[54] STENCIL PRINTER AND METHOD OF STOPPING IN PLACE PRINTING DRUM OF THE PRINTER

[75] Inventors: Yoshikazu Hara; Katsuro Motoe; Hisashi Sanagi, all of Ibaraki-ken, Japan

[73] Assignee: Riso Kagaku Corporation, Tokyo, Japan

[21] Appl. No.: 09/134,545

[22] Filed: Aug. 17, 1998

[30] Foreign Application Priority Data

Aug. 20, 1997 [JP] Japan ..... 9-223861

[51] Int. Cl.[7] ..... B41L 13/04

[52] U.S. Cl. ..... 101/116; 101/486

[58] Field of Search ..... 101/114, 116, 101/117, 118, 129, 477, 484, 485, 486

[56] References Cited

FOREIGN PATENT DOCUMENTS 699541 3/1996 European Pat. Off. .
7-132671 5/1995 Japan .

*Primary Examiner*—Ren Yan
*Attorney, Agent, or Firm*—Sixbey, Friedman, Leedom & Ferguson, PC; Donald R. Studebaker

[57] ABSTRACT

In a stencil printer, a printing drum is provided with a clamp plate for clamping an end portion of a stencil master, thereby holding the stencil master on the printing drum. A paper supply mechanism supplies printing sheets to the printing drum in synchronization with rotation of the printing drum. A first motor drives the paper supply mechanism by way of a first transmission mechanism, and a second transmission mechanism is operatively connected to the first transmission mechanism to be driven by the first motor by way of the first transmission mechanism, thereby rotating the printing drum. A phase adjustment mechanism driven by a second motor drives the second transmission mechanism with the first transmission mechanism held stopped, thereby changing the relative phases of rotation of the printing drum and sheet supply operation of the paper supply means. A drum position sensor generates a detecting signal upon detection that the printing drum comes to a reference position. The first motor is driven to rotate the printing drum and is stopped upon generation of the detecting signal. Then the second motor is driven to rotate the printing drum to the reference position.

6 Claims, 26 Drawing Sheets

STENCIL PRINTER AND METHOD OF STOPPING IN PLACE PRINTING DRUM OF THE PRINTER

BACKGROUND OF THE INVENTION

1. Field of the Invention

This invention relates to a stencil printer and a method of accurately stopping the printing drum of the printer in a predetermined position.

2. Description of the Related Art

In a stencil printer, a stencil master is wrapped around a printing drum and the image on the stencil master is printed on printing sheets by supplying printing sheets to the printing drum while rotating the printing drum.

In order to print the image on the stencil master in a desired position on the printing sheet, it is required to wrap the stencil master in place on the printing drum. For this purpose, it is required that the printing drum is constantly stopped in a predetermined position prior to wrapping the stencil master. That is, the stencil master is fed so that the leading end of the stencil master is positioned in a clamping position where a clamper on the printing drum clamps the leading end of the stencil master, and accordingly the printing drum must be stopped so that the clamper is correctly positioned in the clamping position. For example, when the printing drum is stopped where the clamper is short of the clamping position (short run), the position of the stencil master relative to the printing drum is shifted forward in the direction of rotation of the printing drum from the correct position, which results in upward (i.e., toward the leading end of the printing sheet) shift of the printing position on the printed sheet. On the other hand, when the printing drum is stopped where the damper is positioned beyond the clamping position (overrun), the position of the stencil master relative to the printing drum is shifted rearward in the direction of rotation of the printing drum from the correct position, which results in downward (i.e., toward the trailing end of the printing sheet) shift of the printing position on the printed sheet.

Conventionally when wrapping the stencil master, the printing drum is rotated to a position where the damper is positioned in the clamping position (will be referred to as "the reference position", hereinbelow) by a drum motor which drives the printing drum in printing operation. In order to correctly stop the printing drum in the reference position without being affected by inertia of the printing drum, the drum motor is driven at a speed lower than that in the printing operation. However since the drum motor is arranged to rotate the printing drum at a high speed in the printing operation, reduction of the speed of the drum motor is limited and accordingly it has been very difficult to accurately stop the printing drum in the reference position.

This problem may be overcome by use of a low-speed motor separate from the drum motor for driving the printing drum at a high speed in the printing operation. However this approach is disadvantageous in that an additional motor is required and a means for switching the motors is required, which adds to the cost of the printer.

SUMMARY OF THE INVENTION

In view of the foregoing observations and description, the primary object of the present invention is to provide a stencil printer in which the printing drum can be accurately stopped in the reference position in order to wrap the stencil master without use of an additional motor, thereby preventing shift of the printing position on the printed sheet.

Another object of the present invention is to provide a method of accurately stopping the printing drum of the printer in the reference position.

In accordance with the present invention, when stopping the printing drum in the reference position, the printing drum is first rotated by a drum motor and stopped when a drum position sensor detects that the printing drum comes to the reference position. At this time, the printing drum generally overshoots the reference position since the drum motor rotates the printing drum at a high speed as described above. Then in the present invention, the position of the printing drum is adjusted by use of a motor for driving a phase adjustment means for changing the relative phases of rotation of the printing drum and sheet supply operation of the paper supply means, thereby changing the printing position on the printing sheet. The motor can rotate the printing drum at a very low speed and accordingly the printing drum can be stopped accurately in the reference position without affected by inertia.

That is, in accordance with the present invention, there is provided a stencil printer comprising

- a printing drum which is supported for rotation about its longitudinal axis and is provided with a clamp means for clamping an end portion of a stencil master, thereby holding the stencil master on the printing drum,
- a paper supply means which supplies printing sheets to the printing drum in synchronization with rotation of the printing drum,
- a first motor which drives the paper supply means by way of a first transmission mechanism,
- a second transmission mechanism which is operatively connected to the first transmission mechanism to be driven by the first motor by way of the first transmission mechanism, thereby rotating the printing drum,
- a phase adjustment means which can drive the second transmission mechanism with the first transmission mechanism held stopped, thereby changing the relative phases of rotation of the printing drum and sheet supply operation of the paper supply means,
- a second motor which drives the phase adjustment means,
- a master feed means which feeds a stencil master to a predetermined clamping position in which it is clamped by the clamp means on the printing drum,
- a drum position sensor which generates a detecting signal upon detection that the printing drum comes to a reference position where the clamp means is in said clamping position, and
- a control means into which the detecting signal is input from the drum position sensor and which controls the first and second motors, wherein the improvement comprises that
  - the control means stops the printing drum in said reference position by driving the first motor to rotate the printing drum in one direction, stopping the first motor upon receipt of the detecting signal from the drum position sensor, and driving the second motor to rotate the printing drum to said reference position by way of the second transmission mechanism.

Preferably said control means stops the printing drum in said reference position by driving the first motor to rotate the printing drum in one direction, stopping the first motor upon receipt of the detecting signal from the drum position sensor, driving the second motor to rotate the printing drum in the other direction, stopping the second motor immediately after the drum position sensor stops generating the detecting signal, driving the second motor to rotate the printing drum in said one direction and stopping the second motor upon receipt of the detecting signal from the drum position sensor.

Generally the second transmission mechanism is connected to the first transmission mechanism by way of a planetary gears and the paper supply means is held in place by virtue of detent torque of the first motor. Accordingly, when the second motor is driven, only the printing drum can be rotated.

Thus in accordance with the present invention, the printing drum can be stopped accurately in the reference position without using an additional motor, whereby shift of the printing position can be prevented without substantially adding to the cost.

DESCRIPTION OF THE PREFERRED EMBODIMENT

Figure 1:
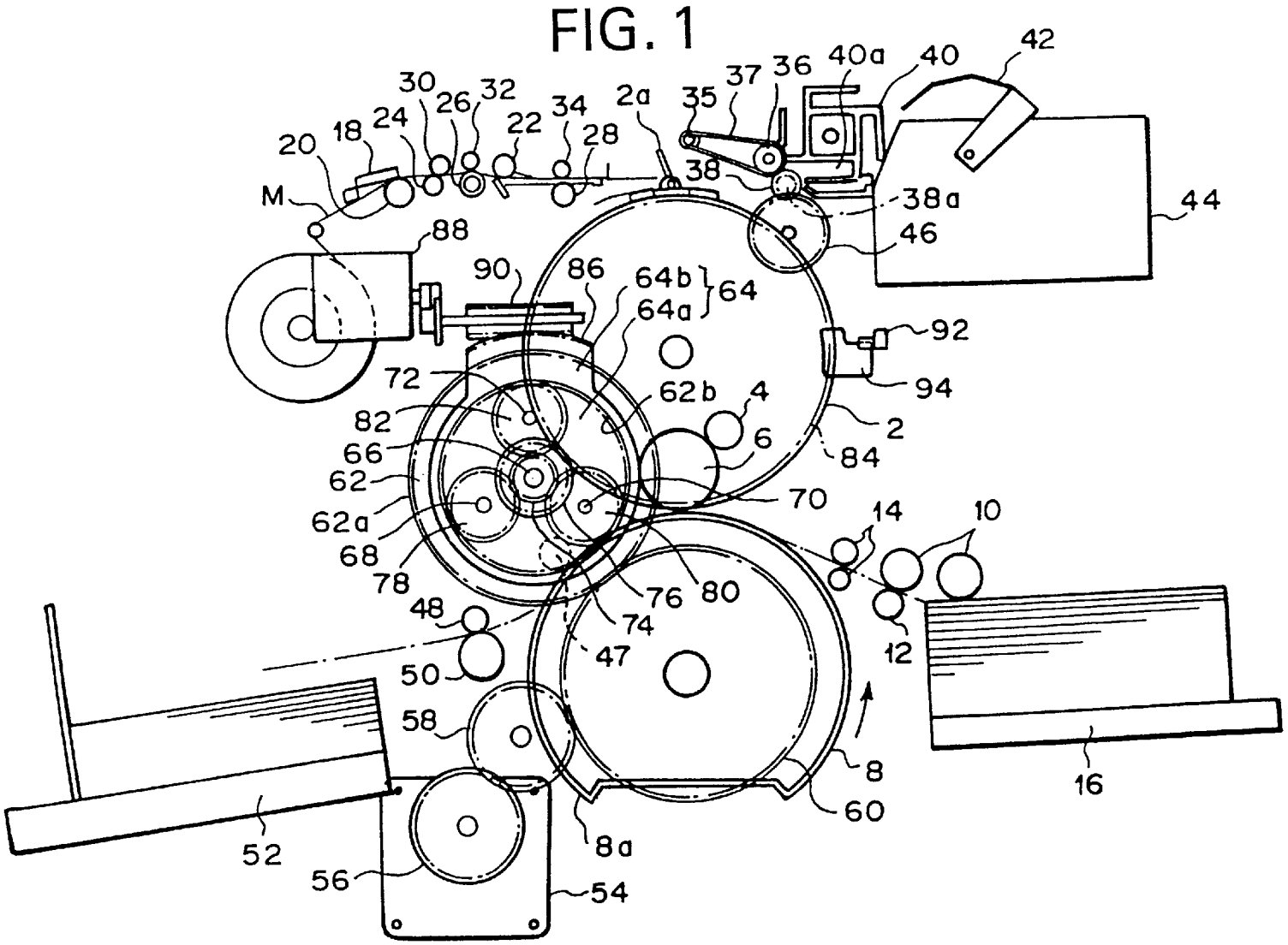
FIG. 1 is a schematic view showing a stencil printer in accordance with an embodiment of the present invention.

In FIG. 1, a stencil printer in accordance with an embodiment of the present invention comprises a printing drum 2 whose circumferential wall is flexible. The circumferential wall has an ink permeable area and an ink impermeable area. A clamp plate 2*a* is mounted on the outer surface of the printing drum 2. A doctor roller 4 and an inner pressing roller 6 are disposed inside the printing drum 2 and supply ink, supplied in an ink fountain between the rollers 4 and 6, from the inside of the printing drum 2 to the outside thereof. The inner pressing roller 6 is driven by a mechanism (not shown) to push the circumferential wall radially outward during the printing operation. The structure of the printing drum 2 and the inner pressing roller 6 has been known as disclosed, for instance, in Japanese Unexamined Patent Publication No. 7(1995)-132671.

Reference numeral 8 denotes a back-up roller. The back-up roller 8 is provided with a clamping piece (not shown) at a portion indicated at 8*a* on the outer surface thereof and the leading end portion of a printed sheet supplied is held on the back-up roller 8 by the clamping piece.

Reference numerals 10, 12 and 14 respectively denote a pair of paper supply rollers, a paper separation roller and a pair timing rollers. Printing sheets stacked on a paper supply table 16 are fed to the timing rollers 14 one by one by the paper supply rollers 10 and the paper separation roller 12. The printing sheet fed to the timing rollers 14 is fed to the back-up roller 8 by the timing rollers 14 and held on the back-up roller 8 by the clamping piece. The printing sheet on the back-up roller 8 is pressed against the stencil master on the printing drum 2 and the image on the stencil master is printed on the printing sheet.

The paper supply rollers 10 are driven in synchronization with each other and with the printing drum 2 by a drive mechanism (not shown). The timing rollers 14 are moved toward and away from each other by a drive mechanism (not shown) at predetermined timings and when moved toward each other, the timing rollers 14 pinch the printing sheet and feed the printing sheet toward the back-up roller 8. Also movement of the timing rollers 14 toward and away from each other and rotation of the rollers 14 are performed in synchronization with rotation of the printing drum 2. The paper supply rollers 10 are rotated and the timing rollers 14 are moved toward and away from each other and rotated by a drum motor 54 (to be described later) by way of a transmission mechanism (not shown).

The paper supply rollers 10, the paper separation roller 12, the timing rollers 14 and the back-up roller 8 form a paper supply means and all these elements are driven in synchronization with rotation of the printing drum 2.

A master making section comprises a thermal heater 18 which perforates a stencil master in a pattern representing an image to be printed, a platen roller 20 and a cutter 22. The platen roller 20 is rotated by a pulse motor (not shown) for writing in synchronization with a roller 24. Master feed rollers 26 and 28 are rotated in synchronization with each other by a master feed motor (not shown) in the form of a stepping motor. Rollers 30, 32 and 34 are in contact with the roller 24, 26 and 28, respectively, under their weight.

A master discharge section comprises a guide roller 35, a pair of master discharge rollers 36 and 38 and a plurality of belts 37 passed around the guide roller 35 and the upper master discharge roller 36. A rotary member 40 which receives stencil masters M is supported for rotation behind the master discharge rollers 36 and 38. The rotary member 40 is like a swastika in shape and is provided with four arms which are bent in the direction of rotation of the rotary member 40 to form master receiving spaces 40*a*. Reference numerals 42 and 44 respectively denote a pressure plate and a discard box.

The belts 37 are arranged in the longitudinal direction of the master discharge roller 36 at regular intervals. A gear 38*a* is coaxially fixed to the lower master discharge roller 38 and is in mesh with a gear 46.

The gear 46 is connected to the drive mechanism for the back-up roller 8 by way of a master discharge clutch (not shown). The upper master discharge roller 36 is pressed against the lower master discharge roller 38, and a used stencil master on the printing drum 2 is conveyed into one of the master receiving spaces 40*a* of the rotary member 40 and compressed by the master discharge rollers 36 and 38. Then the rotary member 40 is rotated by 90° and the used master in the master receiving spaces 40*a* is dropped into the discard box 44 by the pressure plate 42.

The master discharge roller 36 is driven by a discharge motor not shown, though it may be driven by a power source for another mechanism by way of a clutch.

Pinch rollers 47 and 48 are supported for rotation in contact respectively with the back-up roller 8 and a guide roller 50. After printing by the printing drum 2 and the back-up roller 8, the printing sheet is led to a paper discharge table 52 passing between the back-up roller 8 and the pinch roller 47 and between the guide roller 50 and the pinch roller 48.

A gear 56 is fixed to the output shaft of a first motor (drum motor) 54 and is in mesh with a gear 58 which is in mesh with a gear 60 which is fixed to the back-up roller 8 coaxially therewith, whereby the back-up roller 8 is driven by the first motor 54.

A cylindrical drive gear 62 is provided with internal teeth 62*b* and external teeth 62*a*. The external teeth 62*a* of the drive gear 62 are in mesh with the gear 60 on the back-up roller 8.

A support disc 64 comprises a disc portion 64*a* which is in a slidable contact with an end of the drive gear 62 and an extension 64*b* extending radially outward from the disc portion 64*a*. A shaft 66 is erected at the center of the disc portion 64*a* and three shafts 68, 70 and 72 are erected on the disc portion 64*a* around the shaft 66. A gear 74 and a gear 76 larger than the gear 74 in diameter are mounted on the shaft 66 to be rotatable about the shaft 62. The gears 74 and 76 are coaxially fixed to each other. Gears (planetary gears) 78, 80 and 82 are respectively mounted on the shafts 68, 70 and 72 for rotation about the respective shafts. The gears 78, 80 and 82 are in mesh with the internal teeth 62*b* of the drive gear 62 and with the gear 74. The larger diameter gear 76 is in mesh with a gear 84 which is substantially the same as the printing drum 2 in diameter and is fixed to the printing drum 2.

The extension 64*b* of the support disc 64 is provided on the outer side thereof with a worm gear 86, which is in mesh with a worm gear 90 driven by a second motor (printing position changing motor) 88. A stepping motor is used as the second motor 88. Reference numeral 92 denotes a drum position sensor in the form of an interrupter sensor which is turned on and off by a detecting plate 94 on the printing drum 2 to detect that the printing drum 2 is in the reference position where the clamp plate 2*a* on the printing drum 2 is in the clamping position.

When the second motor 88 is driven with the first motor 54 kept stopped, the printing drum 2 is rotated while the back-up roller 8 is kept stopped. That is, when the second motor 88 is rotated, the support disc 64 is rotated about the shaft 66 through engagement of the warm gears 90 and 86, and when the support disc 64 is rotated, the gears 74 and 76 are rotated. When the larger diameter gear 76 is rotated, the printing drum 2 is rotated through the gear 84 fixed to the printing drum 2. However even if the gear 74 is rotated, the gear 60 fixed to the back-up roller 8 is not rotated by the effect of the planetary gears 78, 80 and 82 so long as the first motor 54 is stopped. In this particular embodiment, the first motor 54 is held stopped by its own detent torque. As the first motor 54, there is generally employed one having a certain detent torque. In the case where a motor having a low detent torque is employed, a brake mechanism including, for instance, a clutch or a solenoid, may be provided in the transmission path between the first motor 54 and the gear 60 to selectively hold the back-up roller 8 stationary. Further it is possible to employ a hybrid motor having a built-in brake mechanism. By rotating the printing drum 2 with the back-up roller 8 stopped, the relative position between the printing drum 2 and the back-up roller 8 is changed, which results in upward (i.e., toward the leading end of the printing sheet) or downward (i.e., toward the trailing end of the printing sheet) shift of the printing position on the printed sheet depending on the direction of rotation of the printing drum 2. Thus the printing position on the printed sheet can be adjusted as desired.

In this embodiment, the printing drum 2 is stopped accurately in the reference position where the clamp plate 2*a* is positioned in the predetermined clamping position by use of the second motor 88 for adjusting the printing position as will become apparent later.

Figure 2:
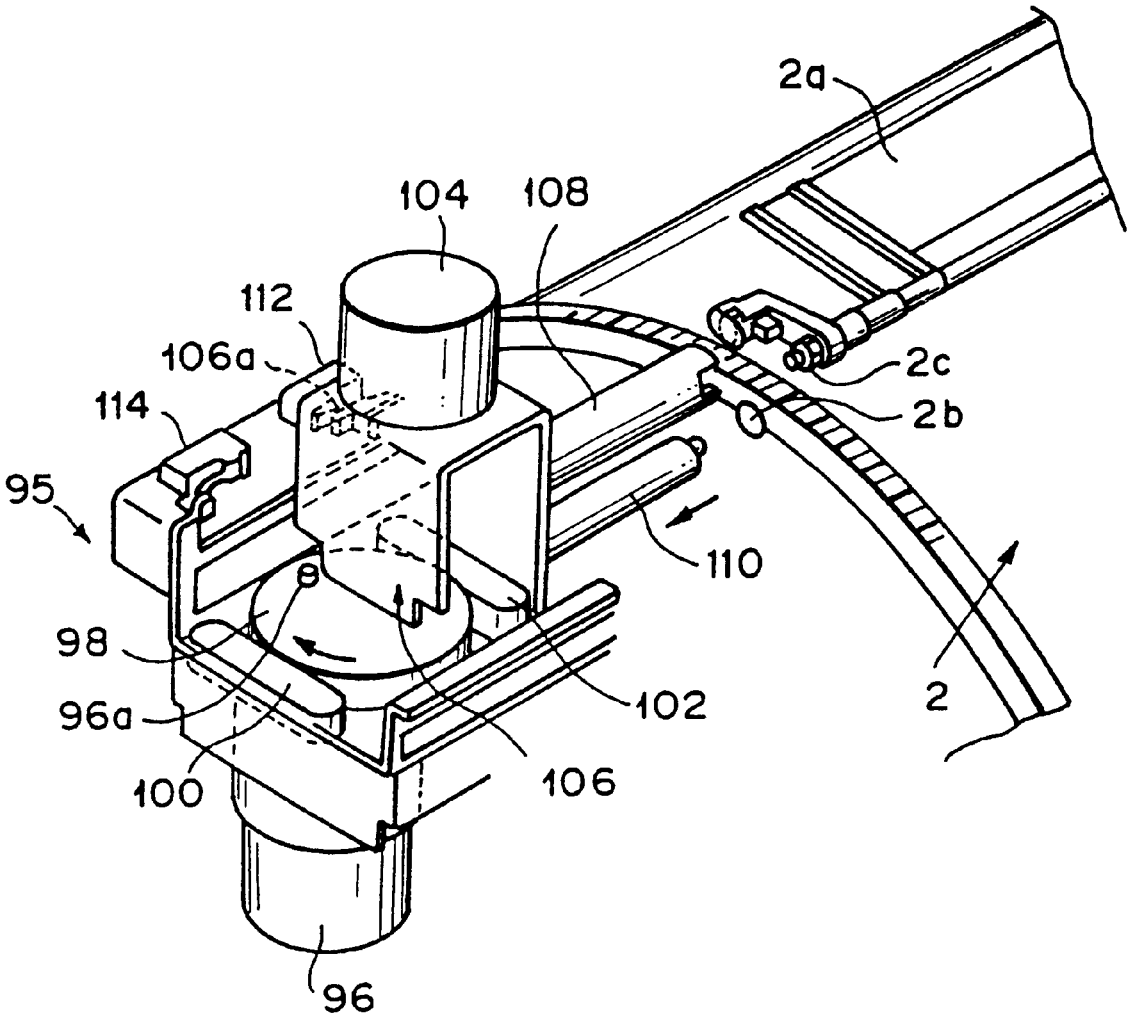
FIG. 2 is a perspective view showing the clamp plate opening and closing mechanism.

A mechanism for opening and closing the clamp plate 95 (a clamp unit) will be described with reference to FIG. 2.

The clamp unit 95 is provided with a clamp drive shaft 108 which is brought into engagement with a joint portion 2*c* on the clamp plate 2*a* and opens and closes the clamp plate 2. That is, movable blocks 100 and 102 are mounted on the printer body to be slidable back and forth toward and away from the printing drum 2 in a direction parallel to the longitudinal axis of the printing drum 2. The movable block 102 is driven by a clamp engaging motor 96 by way of a cam disc 98 which is eccentrically fixed to the output shaft 96*a* of the motor 96. The cam disc 98 is disposed between the movable blocks 100 and 102 in contact with the blocks. Thus the movable block 102 is moved toward and away from the printing drum 2 when the cam disc 98 is rotated about the output shaft 96*a* of the motor 96 by the motor 96.

A support member 106 is disposed to be moved back and forth integrally with the movable block 102. A clamp opening and closing motor 104 is mounted on the support member 106 and the clamp drive shaft 108 and a locator shaft 110 project toward the printing drum 2 from the support member 106. The clamp drive shaft 108 is rotated about its longitudinal axis by the clamp opening and closing motor 104 by way of a transmission mechanism (not shown) disposed in the support member 106. The locator shaft 110 is adapted to be engaged with a locator hole 2*b* formed in the printing drum 2 to locate the clamp drive shaft 108 with respect to the joint portion 2*c* on the clamp plate 2*a*.

When the clamp engaging motor 96 is rotated in one direction with the clamp unit 95 away from the printing drum 2, the support member 106 is moved toward the printing drum 2 and the leading end of the locator shaft 110 is brought into engagement with the locator hole 2*b* to locate the clamp drive shaft 108 with respect to the joint portion 2*c* on the clamp plate 2*a*, whereby the clamp drive shaft 108 is brought into engagement with the joint portion 2*c*. Then when the clamp opening and closing motor 104 is driven, the clamp plate 2*a* if opened or closed depending on the direction of rotation of the motor 104. When the clamp engaging motor 96 is reversed after thus opening or closing the clamp plate 2*a*, the clamp drive shaft 108 is retracted from the joint portion 2*c* of the clamp plate 2*a* and the locator shaft 110 is moved away from the locator hole 2*b*, thereby releasing the printing drum 2.

The angular position of the clamp drive shaft 108 is detected by a clamp drive shaft position sensor (not shown) disposed in the support member 106. The clamp drive shaft position sensor is turned on when the clamp drive shaft 108 is in the angular position where the engagement groove formed on the tip of the clamp drive shaft 108 can be brought into engagement with the joint portion 2*c* of the clamp plate 2*a*.

A clamp engagement sensor 112 and a clamp disengagement sensor 114 are disposed on the printer body spaced from each other along the path of travel of the support member 106. An actuator piece 106*a* is disposed on the support member 106 so that when the support member 106 is in the home position where the clamp drive shaft 108 is disengaged from the joint portion 2*c*, the actuator piece 106*a* turns on the clamp disengagement sensor 114 and when the support member 106 is in the operable position where the clamp drive shaft 108 is engaged with the joint portion 2*c*, the actuator piece 106*a* turns on the clamp engagement sensor 112.

Figure 3:
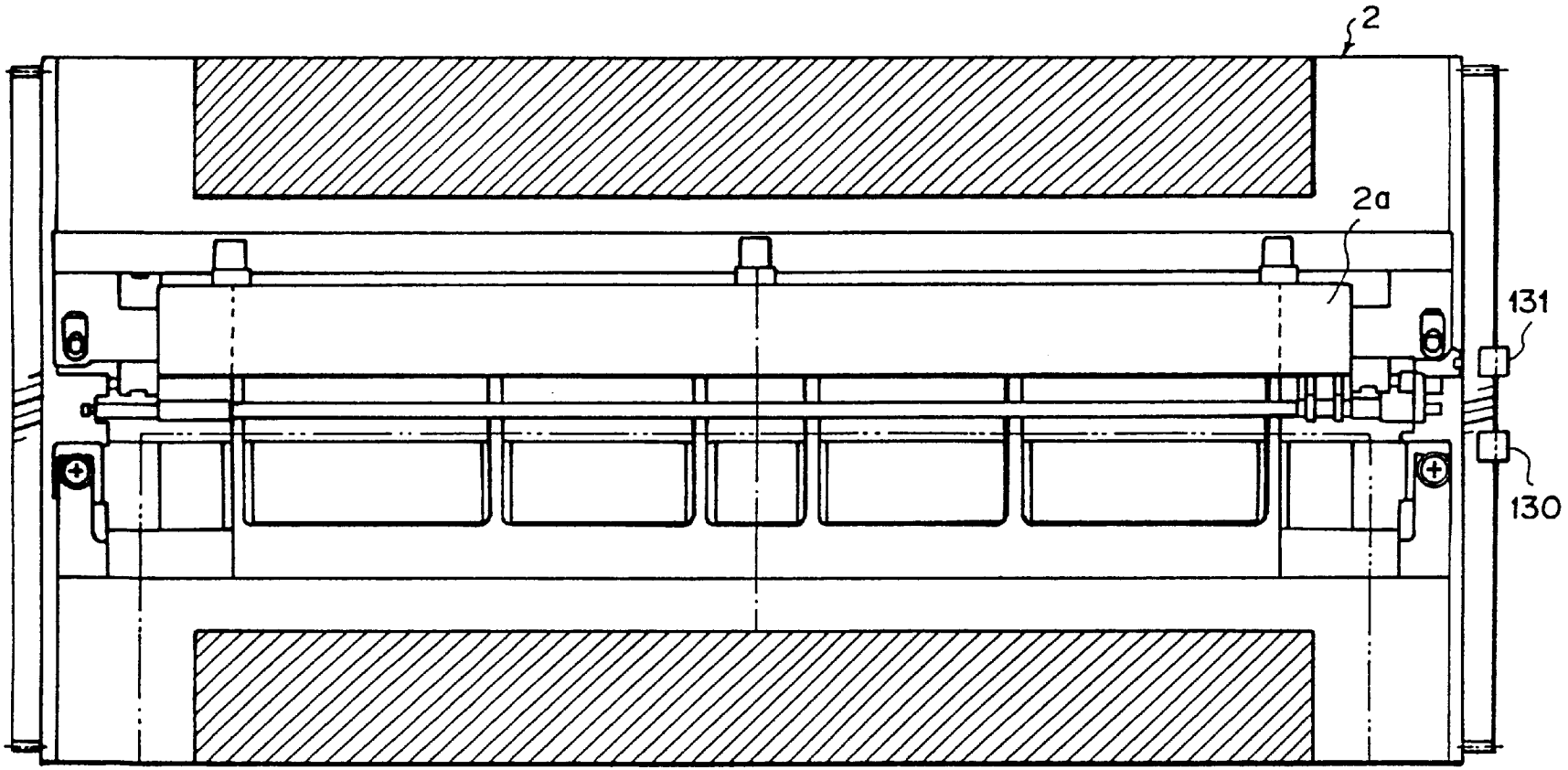
FIG. 3 is a plan view of the printing drum.

As shown in FIG. 3, the printing drum 2 is provided with a clamp closure sensor 130 which detects that the clamp plate 2*a* is closed and holds the stencil master. During printing, the clamp plate 2*a* is kept holding the stencil master. Further the printing drum 2 is provided with a clamp opening sensor 130 which detects that the clamp plate 2*a* is opened and releases the stencil master. When a used stencil master is to be discharged, the clamp plate 2*a* is kept open.

Figure 4:
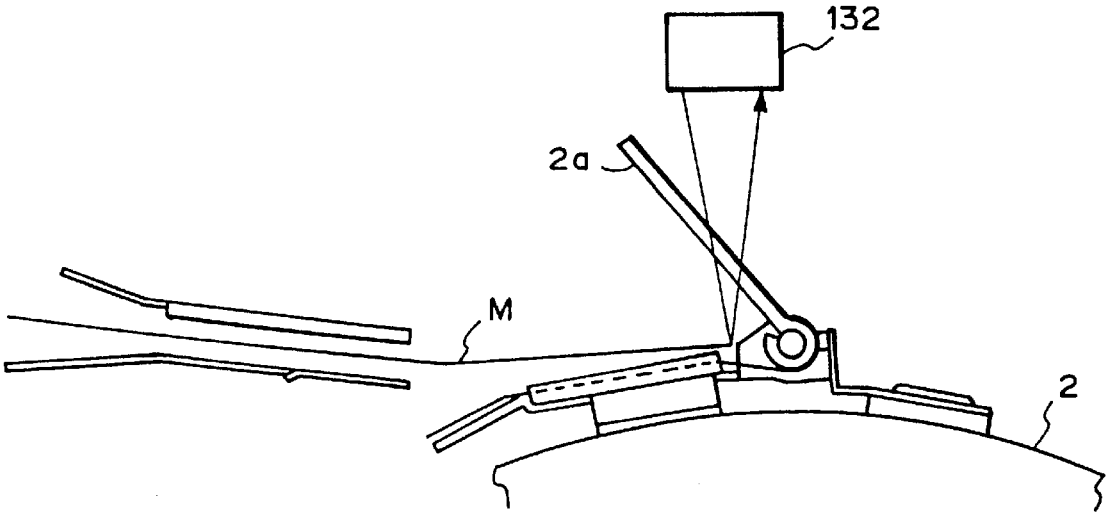
FIG. 4 is a fragmentary side view showing the clamp plate of the printing drum.

As shown in FIG. 4, a master position sensor 132 detects that the stencil master M fed from the master making section is in the clamping position.

Figure 5:
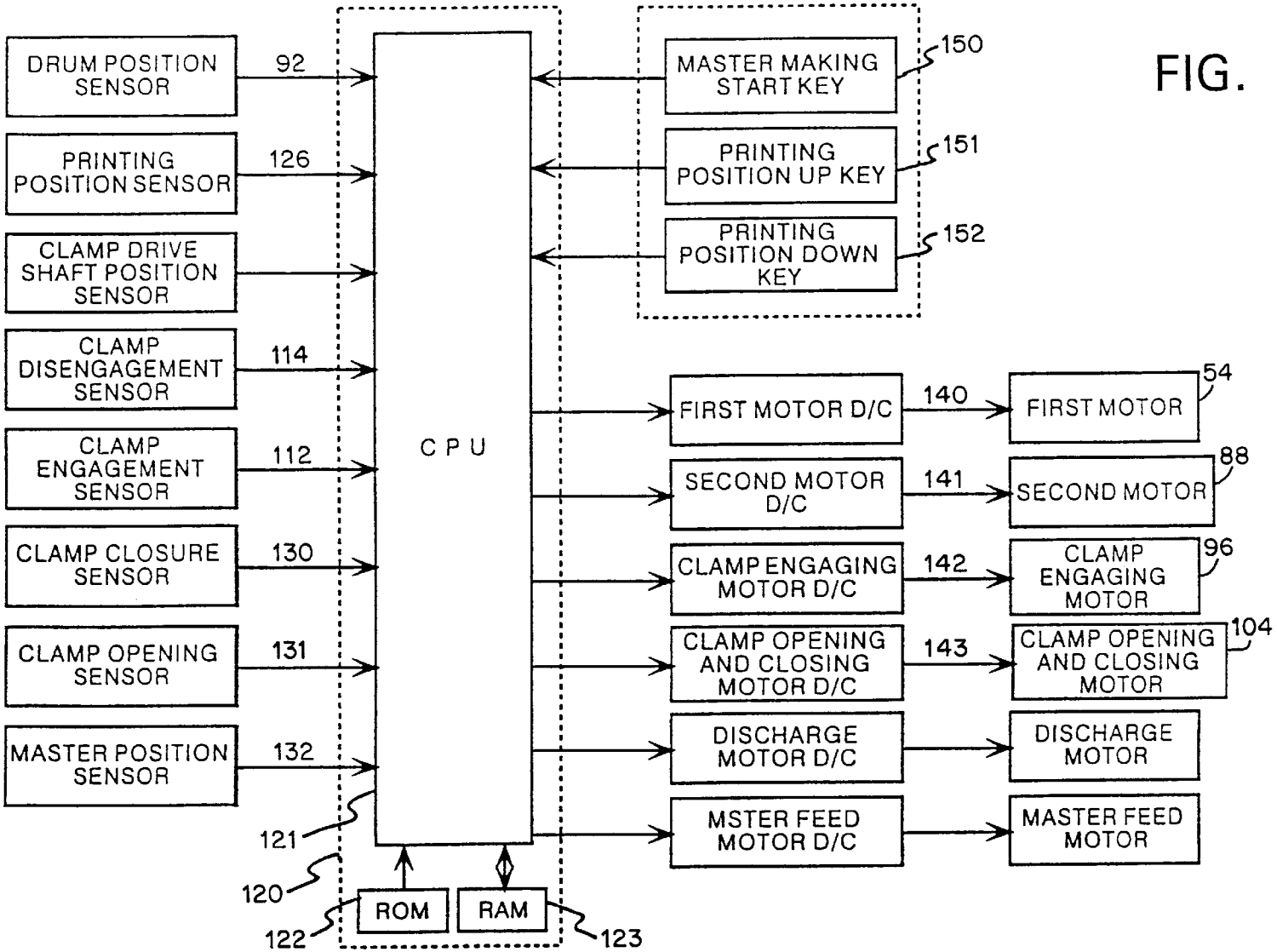
FIG. 5 is a block diagram showing the electric arrangement of the printer.

An electric arrangement of the printer of this embodiment will be described with reference to FIG. 5, hereinbelow.

The printer of this embodiment is provided with a control means 120 which may comprise a one-chip microcomputer. The control means 120 comprises a CPU 121 which controls the mechanisms described above, a ROM 122 in which control program is stored and a RAM 123 in which working variables, the printing position and the like necessary for operation of the CPU 121 are stored.

Detecting signals of the sensors are input into the CPU 121.

A printing position sensor 126 detects the printing position on the printing sheet in the direction of feed of the printing sheet. That the printing position sensor 126 is ON means that the printing position is shifted upward (toward the leading end of the printing sheet as seen in the direction of feed of the printing sheet) from the standard position and that the printing position sensor 126 is OFF means that the printing position is shifted downward (toward the trailing end of the printing sheet as seen in the direction of feed of the printing sheet) from the standard position. The regular position corresponds to the position where the printing position sensor 126 is just turned ON from the OFF state.

A first motor drive circuit 140 drives the first motor (drum motor) 54 under the control of a control signal from the control means 120. A second motor drive circuit 141 drives the second motor (printing position changing motor) 88 under the control of a control signal from the control means 120 to shift the phase of the printing drum 2 from that of the back-up roller 8, thereby shifting the printing position on the printing sheet upward or downward depending on the direction of rotation of the second motor 88. When the second motor 88 is rotated in the regular direction, the printing position is shifted upward and when the second motor 88 is rotated in the reverse direction, the printing position is shifted downward. For rotation of the second motor 88 for 100 ms, the printing position is shifted by 0.1 mm upward or downward.

A clamp engaging motor drive circuit 140 drives the clamp engaging motor 96 to move the clamp unit 95 back and forth. When the clamp engaging motor 96 is rotated in the regular direction, the clamp unit 95 is moved toward the printing drum 2, and when the clamp engaging motor 96 is rotated in the reverse direction, the clamp unit 95 is moved away from the printing drum 2.

A clamp opening and closing motor drive circuit 143 drives the clamp opening and closing motor 104. Rotation of the clamp opening and closing motor 104 in the regular direction closes the clamp plate 2*a* and rotation of the same in the reverse direction opens the clamp plate 2*a*.

A discharge motor drive circuit drives the discharge motor to rotate the master discharge roller 36 which peels the stencil master off the printing drum 2.

A master feed motor drive circuit drives the master feed motor to rotate the master feed roller 28 which feeds the master made by the master making section to the clamping position.

The printer is provided with a control panel on which a master making start key 150 for causing the master making section to start making a stencil master, a printing position up key 151 for shifting upward the printing position and a printing position down key 151 for shifting downward the printing position.

The operation of the printer with the arrangement described above will be described, hereinbelow.

Figure 6:
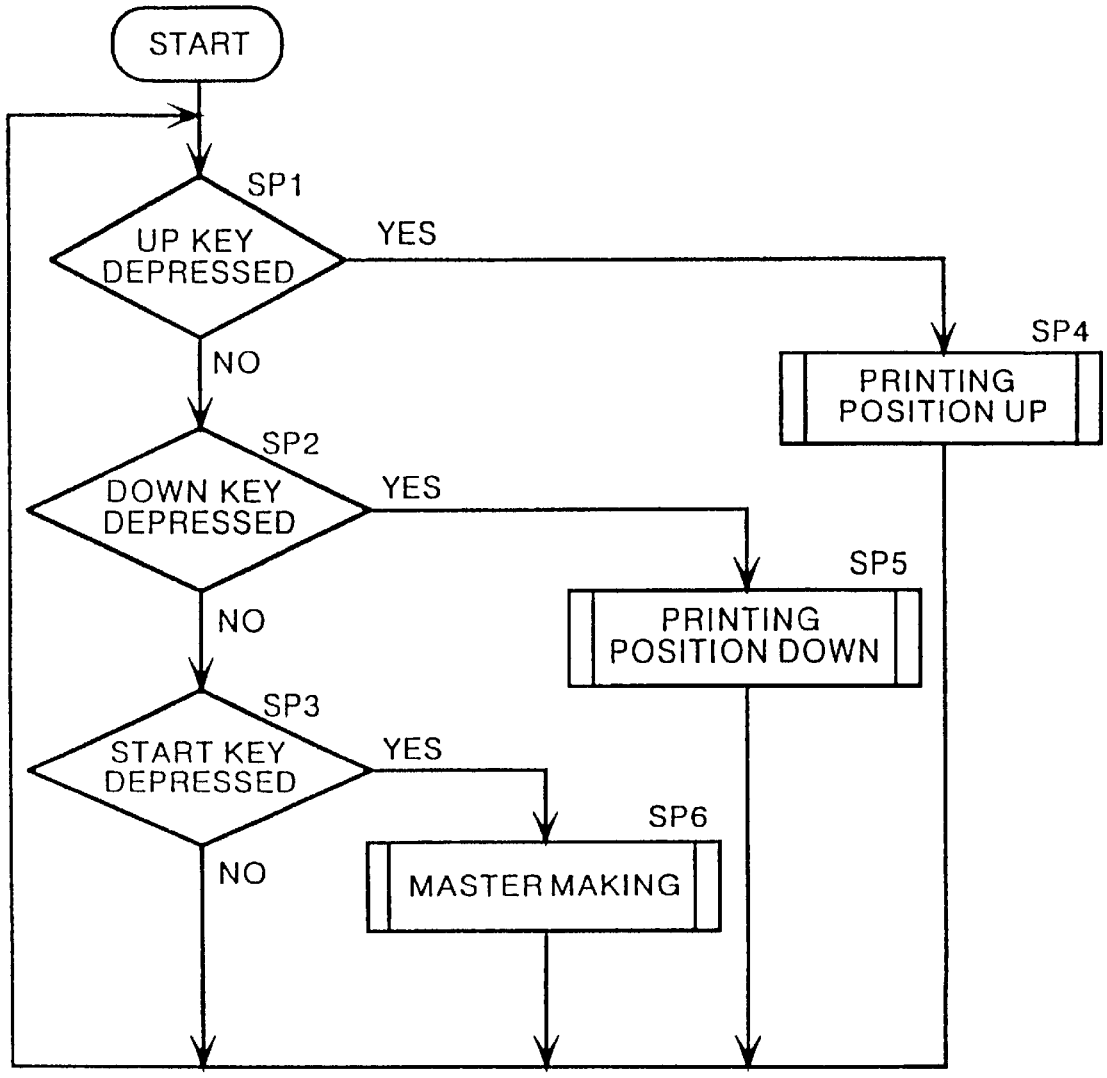
FIG. 6 is a main flow chart for illustrating the operation of the printer.

In FIG. 6, the control means 120 first determines whether the printing position up key 151 has been depressed (SP1) and when it is determined that the printing position up key 151 has been depressed (SP1:YES), the control means 120 executes operation of shifting upward the printing position (SP4). When it is determined that the printing position up key 151 has not been depressed (SP1:NO), the control means 120 determines whether the printing position down key 152 has been depressed (SP2) and when it is determined that the printing position down key 151 has been depressed (SP2:YES), the control means 120 executes operation of shifting downward the printing position (SP5). When it is determined that the printing position down key 152 has not been depressed (SP2:NO), the control means 120 determines whether the master making start key 150 has been depressed (SP3) and when it is determined that the master making start key 150 has been depressed (SP3:YES), the control means 120 executes operation of making the master (SP6). Otherwise the control means 120 returns to SP1.

Figure 7:
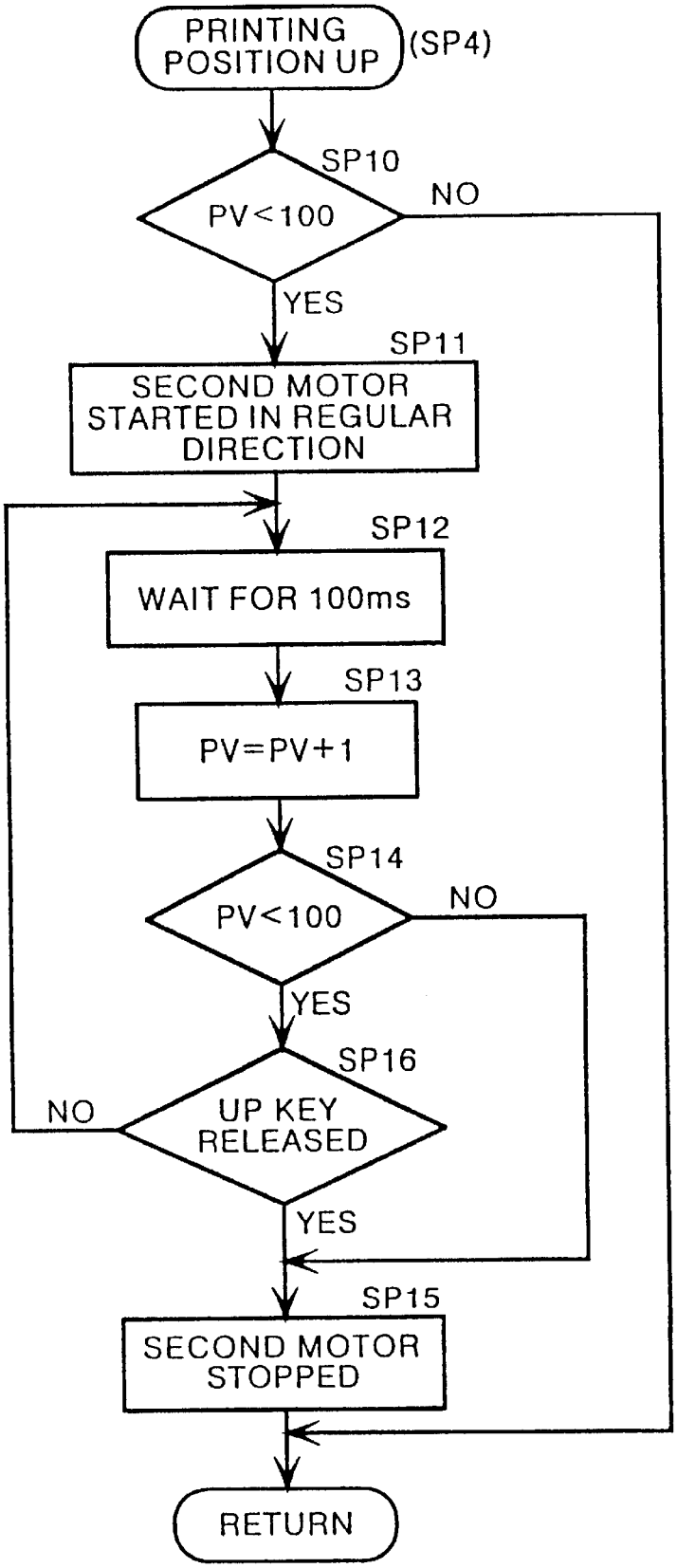
FIG. 7 is a flow chart for illustrating the printing position up operation.

FIG. 7 shows a flow chart for illustrating the operation of shifting upward the printing position to be executed in SP4. In FIG. 7, the control means 120 first determines whether a printing position variable PV representing the current printing position is smaller than 100 (SP10). When it is determined that the printing position variable PV is not smaller than 100 (SP10:NO), that is, when the printing position is shifted from the regular position by a distance not smaller than 10 mm, the operation of shifting upward the printing position is not executed. This is for the purpose of protecting the mechanism.

The printing position variable represents the shift in phase between the printing drum 2 and the paper supply means, and the value of the variable is set to 0 when the phases of the printing drum 2 and the paper supply means are in such a relation that provides the regular printing position. A positive value of the variable represents that phase difference between the printing drum 2 and the paper feed means causes an upward shift of the printing position from the regular position and a negative value of the variable represents that phase difference between the printing drum 2 and the paper feed means causes a downward shift of the printing position from the regular position with the absolute value of the variable representing ten times the amount of the shift in terms of mm.

When it is determined that the printing position variable PV is smaller than 100 (SP10:YES), the control means 120 causes the second motor 88 to rotate in the regular direction to shift upward the printing position (SP11). The printing position is shifted by 0.1 mm each time the second motor 88 rotates for 100 ms. The printing position variable PV is incremented by one every 100 ms (SP12, SP13), and when the printing variable PV reaches 100 (SP14:NO), the second motor 88 is stopped and the operation is ended (SP15). Until the printing variable PV reaches 100 (SP14:YES), it is determined whether the printing position up key 151 has been released (SP16), and when it is determined that the printing position up key 151 has been released (SP16:YES), the second motor 88 is stopped (SP15). When it is determined that the printing position up key 151 is kept depressed (SP16:NO), SP12 and the following steps are repeated. Thus by releasing the printing position up key 151 at a proper timing, the printing position can be shifted upward by a desired amount.

Figure 8:
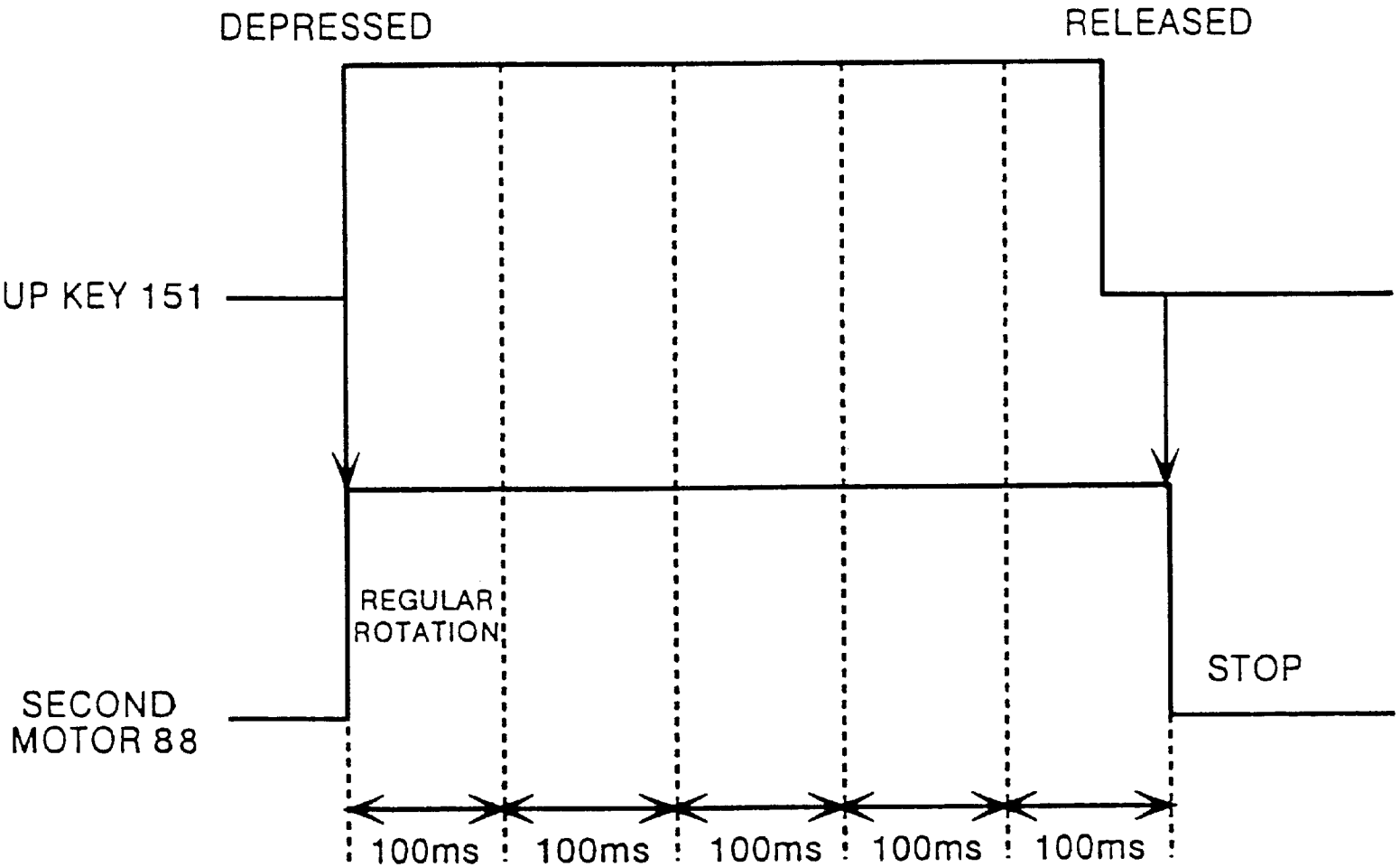
FIG. 8 is a timing chart for the printing position up operation.

FIG. 8 is a timing chart for illustrating the relation between the state of the printing position up key 151 and the rotation of the second motor 88.

As shown in FIG. 8, while the printing position up key 151 is kept depressed, the second motor 88 continuously rotates in the regular direction to shift upward the printing position. The second motor 88 is rotated 100 ms by 100 ms from the time the printing position up key is depressed and is stopped when 100 ms at the time the printing position up key 151 is released elapses. In the example shown in FIG. 8, the printing position up key 151 is released in the fifth 100 ms, and accordingly the second motor 88 rotates for 500 ms and the printing position is shifted upward by 0.5 mm from the regular position.

Figure 9:
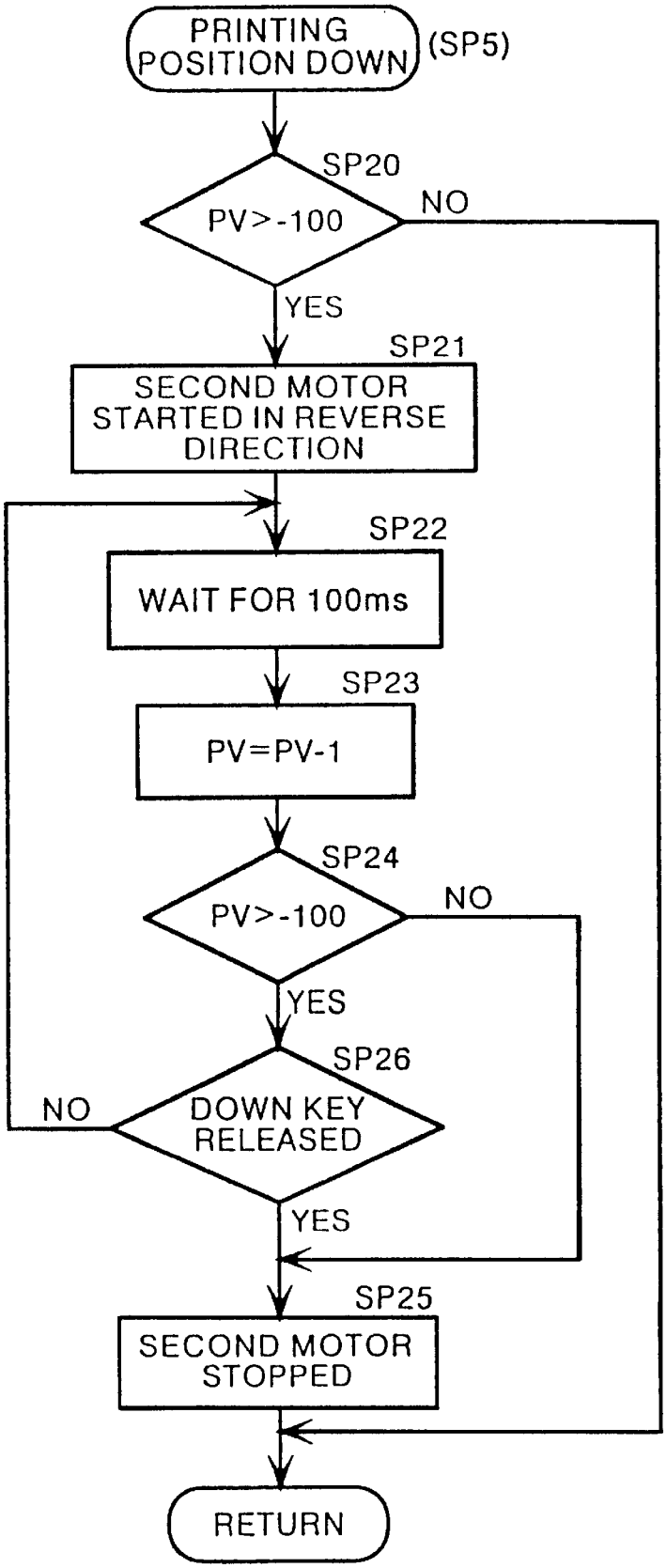
FIG. 9 is a flow chart for illustrating the printing position down operation.

FIG. 9 shows a flow chart for illustrating the operation of shifting downward the printing position to be executed in SP5 shown in FIG. 6. This operation is substantially the same as the operation of shifting upward the printing position shown in FIG. 7 except that the printing position variable PV is limited to −100 (SP20, SP24), the printing variable PV is decremented by −1 (SP23), the second motor 88 is rotated in the reverse direction and the printing position down key 152 is watched (SP26).

Figure 10:
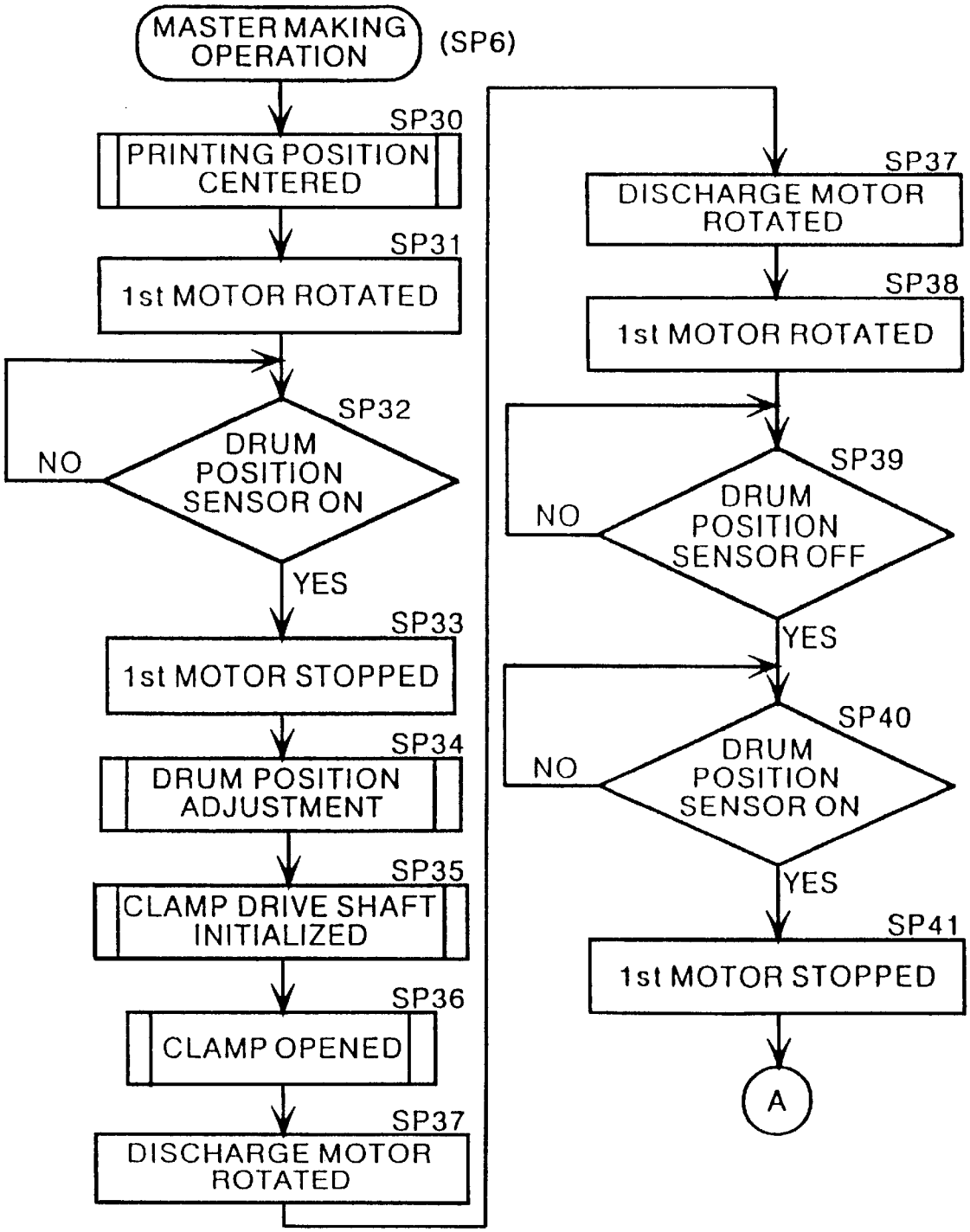
FIGS. 10 and 11 show a flow chart for illustrating the master making operation.

The master making operation (SP6 in FIG. 6) will be described with reference to a flow chart shown in FIGS. 10 and 11, hereinbelow. In FIG. 10, the control means 120 first moves the printing position to the regular position (printing position centering operation). (SP30) This step is carried out for preventing the printing position adjusting mechanism from being damaged, which can occur when a drum position adjustment operation to be described later is carried out with the printing position kept in the upper or lower limit. Accordingly if the printing position adjusting mechanism is operable beyond the upper and lower limits by a sufficient amount, step SP30 may be eliminated. Further it is possible to detect the current printing position on the basis of the printing position variable PV and to execute step SP30 only when there is fear that the printing position adjusting mechanism can be damaged.

The printing position centering operation is for centering the printing position or for returning the printing position to the regular position. The regular position corresponds to the position where the printing position sensor 126 is just turned on from the off-state when the second motor 88 is rotated in the regular direction. The printing position sensor 126 is mounted on the printer body and is turned on and off by an actuator piece (not shown) on the support disc 64 (FIG. 1) in response to rotation of the support disc 64 which is driven by the second motor 88.

The reason why "on" and "off" of the printing position sensor 126 is detected only in one direction is to prevent occurrence of error due to backlash in the printing position adjusting mechanism. Accordingly if the printing position adjusting mechanism is arranged so that the printing position is not affected by backlash in the mechanism, the regular position may be defined as a position where the printing position sensor 126 is just turned off from the on-state in response to rotation of the second motor 88 in the reverse direction.

Figure 12:
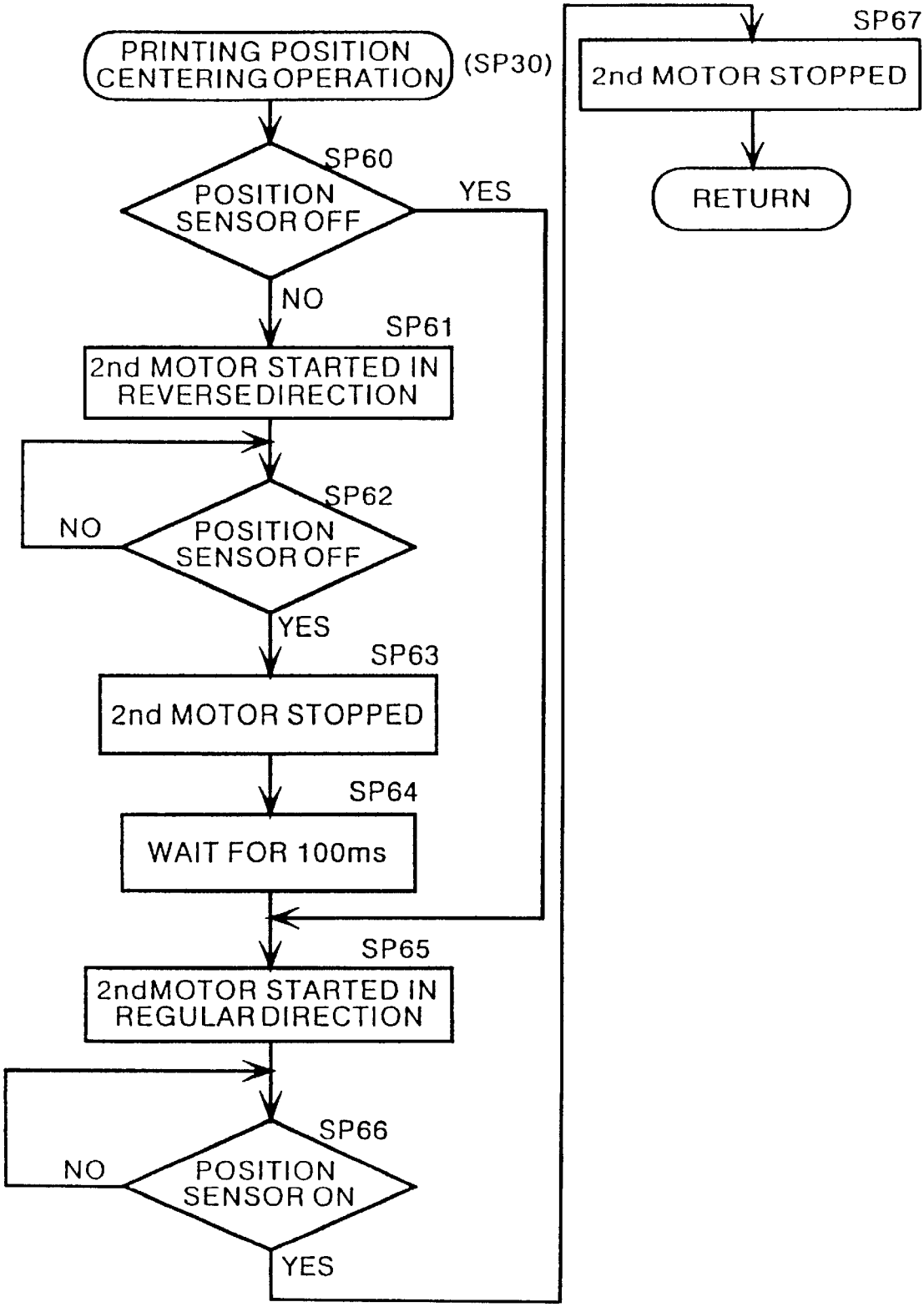
FIG. 12 is a flow chart for illustrating the printing position centering operation.

The printing position centering operation (SP30) will be described with reference to the flow chart shown in FIG. 12, hereinbelow.

If the printing position sensor 126 is on upon initiation of this operation (SP60:NO), the second motor 88 is rotated in the reverse direction until the printing position sensor 126 is turned off (SP61, SP62), and is stopped (SP63) when the printing position sensor 126 is turned off (SP62:YES). Then after 100 ms, the second motor 88 is rotated in the regular direction (SP65) and when the printing position sensor 126 is turned on (SP66:YES), the second motor 88 is stopped (SP67). Thus the printing position is centered. When the printing position sensor 126 is off upon initiation of this operation (SP60:YES), SP65 is executed immediately after SP60.

Figure 13A:
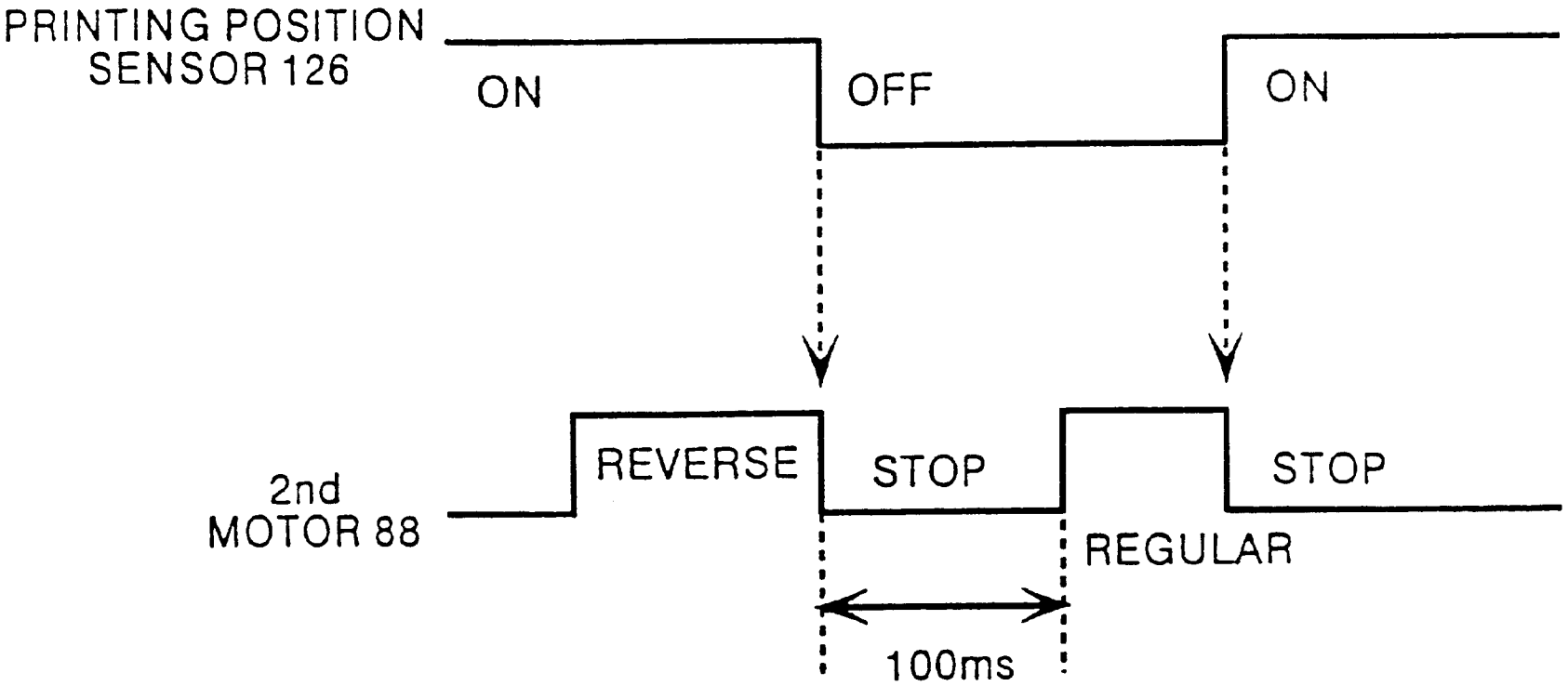
FIGS. 13A and 13B are timing charts for the printing position centering operation.
Figure 13B:
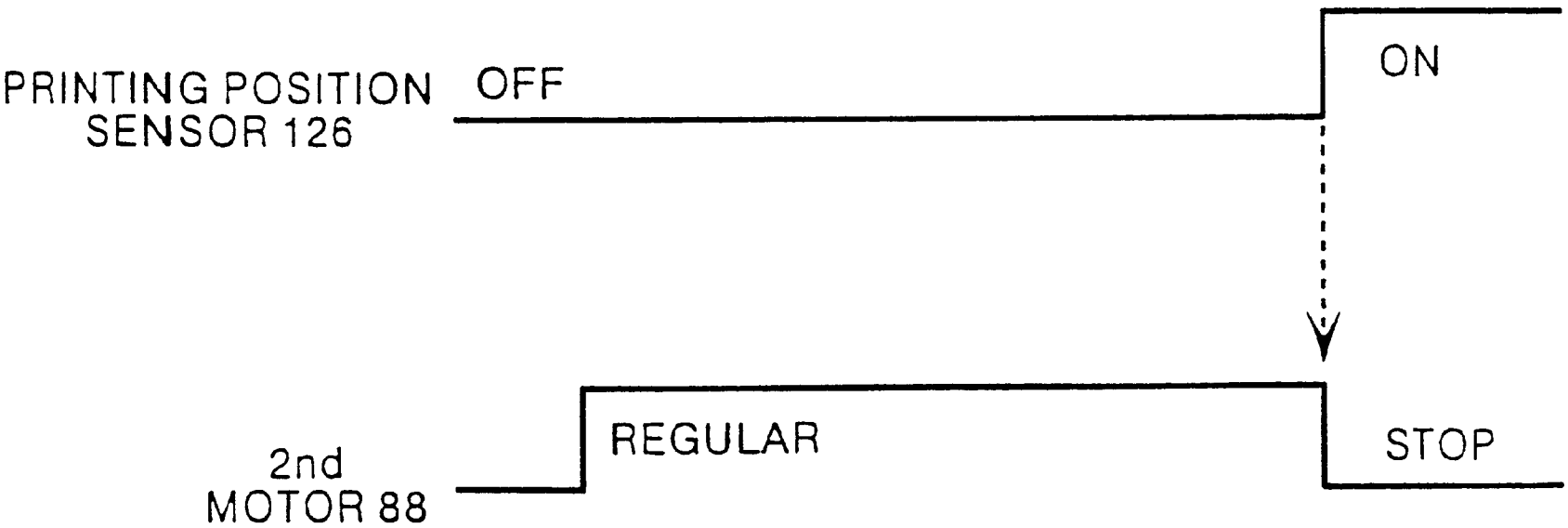

FIGS. 13A and 13B show the timings of operation of the printing position sensor 126 and the second motor 88. FIG. 13A shows the timings when SP60 (NO) to SP67 are executed. The waiting time of 100 ms in SP64 is set for the purpose of cancelling influence of inertia of the second motor 88 and the like. This waiting time may be changed depending on design. FIG. 13B shows the timings when SP60 (YES), SP65 and SP66 are executed.

After end of the printing position centering operation (SP30), the first motor 54 is driven to bring the printing drum 2 to the reference position where the clamp plate 2*a* on the printing drum 2 is in the clamping position (SP31 to SP33). At this time, the first motor 54 is stopped when the drum position sensor 92 is turned on. However since the first motor 54 rotates the printing drum 2 at a relatively high speed, the printing drum 2 cannot be stopped immediately after the drum position sensor 92 is turned on and generally overshoots the reference position.

Figure 14:
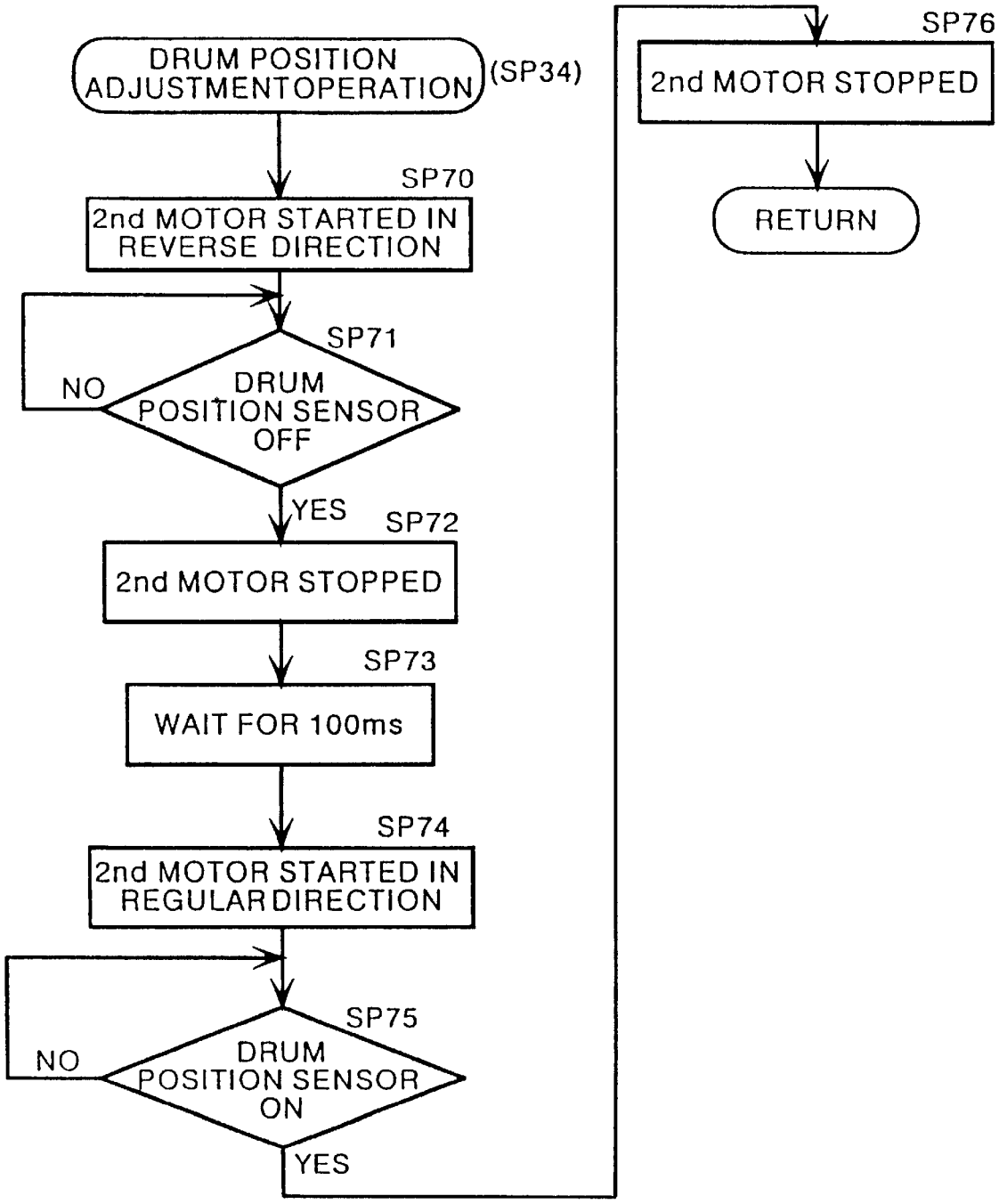
FIG. 14 is a flow chart for illustrating the drum position adjustment operation.

Accordingly, a drum position adjustment operation is executed to stop the printing drum 2 accurately in the reference position (SP34). The drum position adjustment operation will be described with reference to the flow chart shown in FIG. 14, hereinbelow.

The second motor 88 is first started in the reverse direction to rotate the printing drum 2 in the reverse direction at a very low speed (SP70) until the drum position sensor 92 is turned off (SP71:YES). When the drum position sensor 92 is turned off, the second motor 88 is stopped to stop the printing drum 2 (SP72). After 100 ms (SP73), the second motor is started in the regular direction to rotate the printing drum 2 in the regular direction at a very low speed (SP74) until the drum position sensor 92 is turned on (SP75:YES). When the drum position sensor 92 is turned on, the second motor 88 is stopped to stop the printing drum 2 (SP76). Thus the drum position adjustment operation is ended. Since the second motor 88 rotates the printing drum 2 at a very low speed, the printing drum 2 can be stopped in the reference position at a high accuracy without being affected by its inertia.

Figure 15:
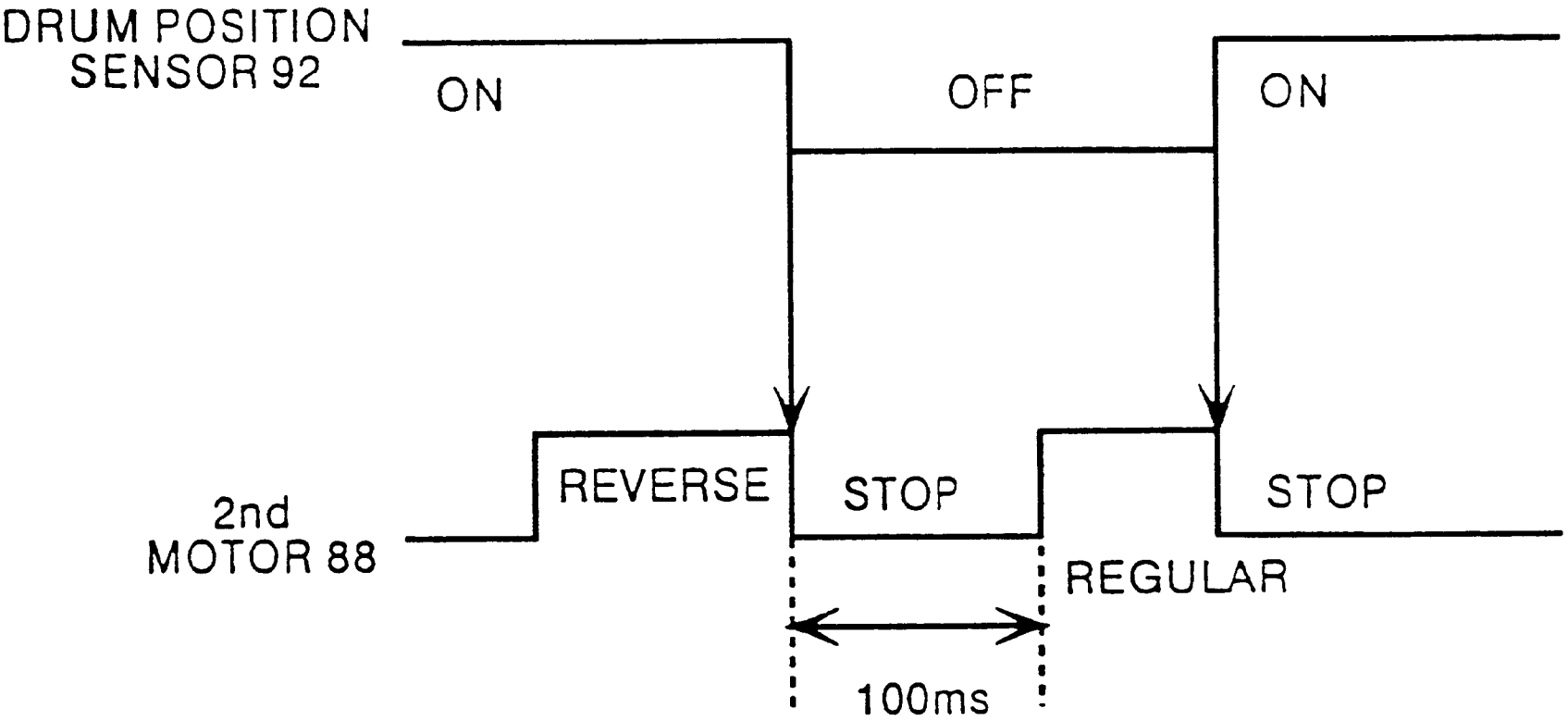
FIG. 15 is a timing chart for the drum position adjustment operation.

FIG. 15 shows the timings of operation of the drum position sensor 92 and the second motor 88 when SP70 to SP76 are executed. The waiting time of 100 ms in SP73 is set for the purpose of cancelling influence of inertia of the second motor 88 and the like. This waiting time may be changed depending on design.

Figure 16:
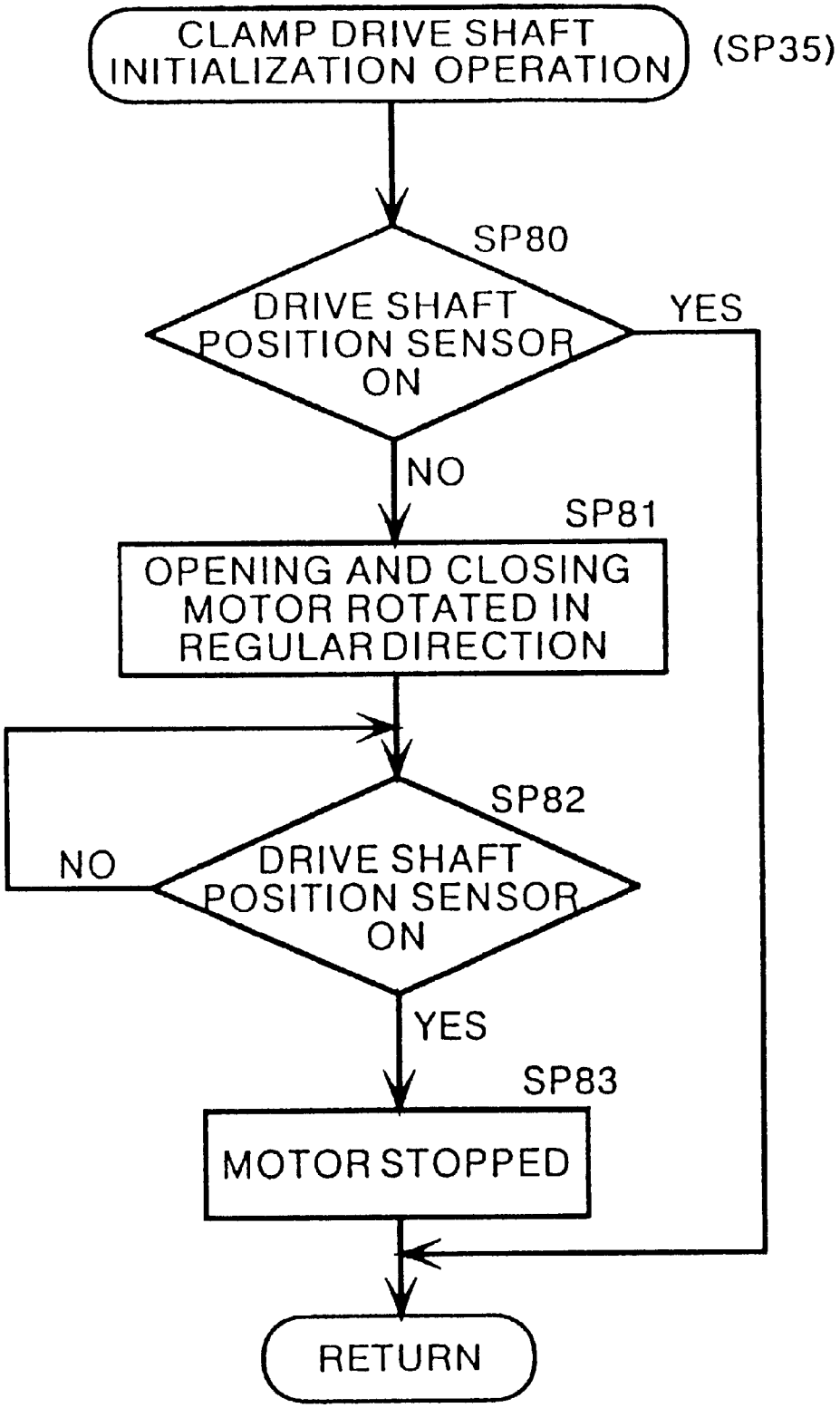
FIG. 16 is a flow chart for illustrating the clamp drive shaft initialization operation.

Again referring to FIG. 10, a clamp drive shaft initialization operation is executed (SP35) after the drum position adjustment operation. The clamp drive shaft initialization operation will be described with reference to FIG. 16, hereinbelow.

The clamp drive shaft initialization operation is for bringing the clamp drive shaft 108 to the angular position where the clamp drive shaft 108 can be brought into engagement with the joint portion 2*c* of the clamp plate 2*a*.

When the clamp drive shaft position sensor is on (SP80:YES), this operation is ended since the clamp drive shaft 108 has been in the angular position where the clamp drive shaft 108 can be brought into engagement with the joint portion 2*c* of the clamp plate 2*a*.

When the clamp drive shaft position sensor is off (SP80:NO), the clamp opening and closing motor 104 is rotated in the regular direction (SP81) until the sensor is turned on (SP82:YES). Then the motor 104 is stopped (SP83).

Figure 17:
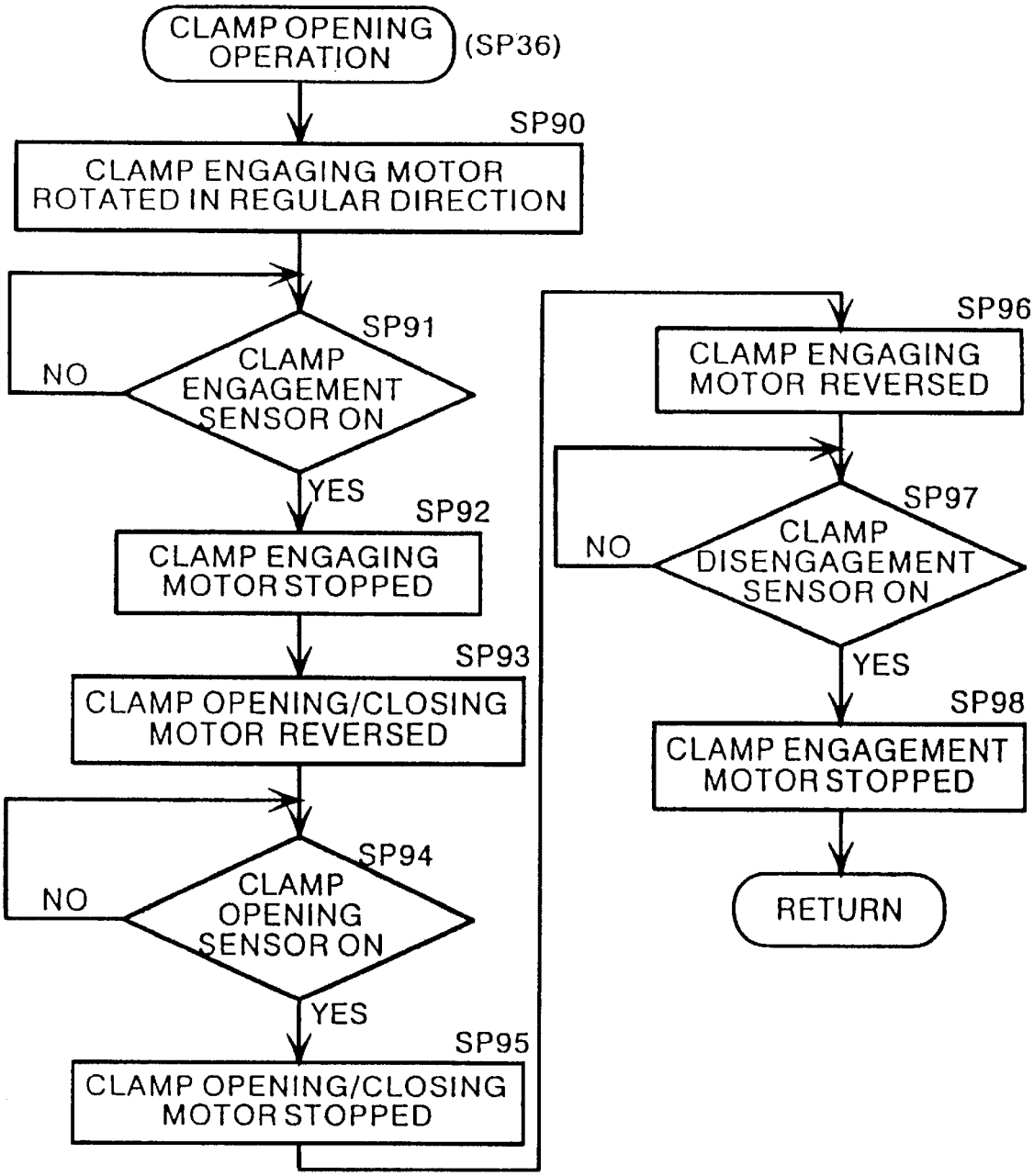
FIG. 17 is a flow chart for illustrating the clamp opening operation.

Then a clamp opening operation is executed (SP36 in FIG. 10). This operation will be described with reference to the flow chart shown in FIG. 17, hereinbelow. This operation is for opening the clamp plate 2*a* on the printing drum 2.

The clamp engaging motor 96 is rotated in the regular direction to move the clamp unit 95 toward the printing drum 2, thereby bringing the clamp drive shaft 108 into engagement with the joint portion 2*c* of the clamp plate 2*a* (SP90). When the clamp engagement sensor 112 is turned on (SP91:YES), the clamp engaging motor 96 is stopped (SP92).

Then the clamp opening and closing motor 104 is rotated in the reverse direction, thereby opening the clamp plate 2*a* (SP93). When the clamp opening sensor 131 is turned on (SP94:YES), the clamp opening and closing motor 104 is stopped (SP95). Thereafter the clamp engaging motor 96 is reversed to move the clamp unit 95 away from the printing drum 2 (SP96). Then when the clamp disengagement sensor 114 is turned on (SP97:YES), the clamp engaging motor 96 is stopped (SP98). Thus this operation is ended.

Figure 18:
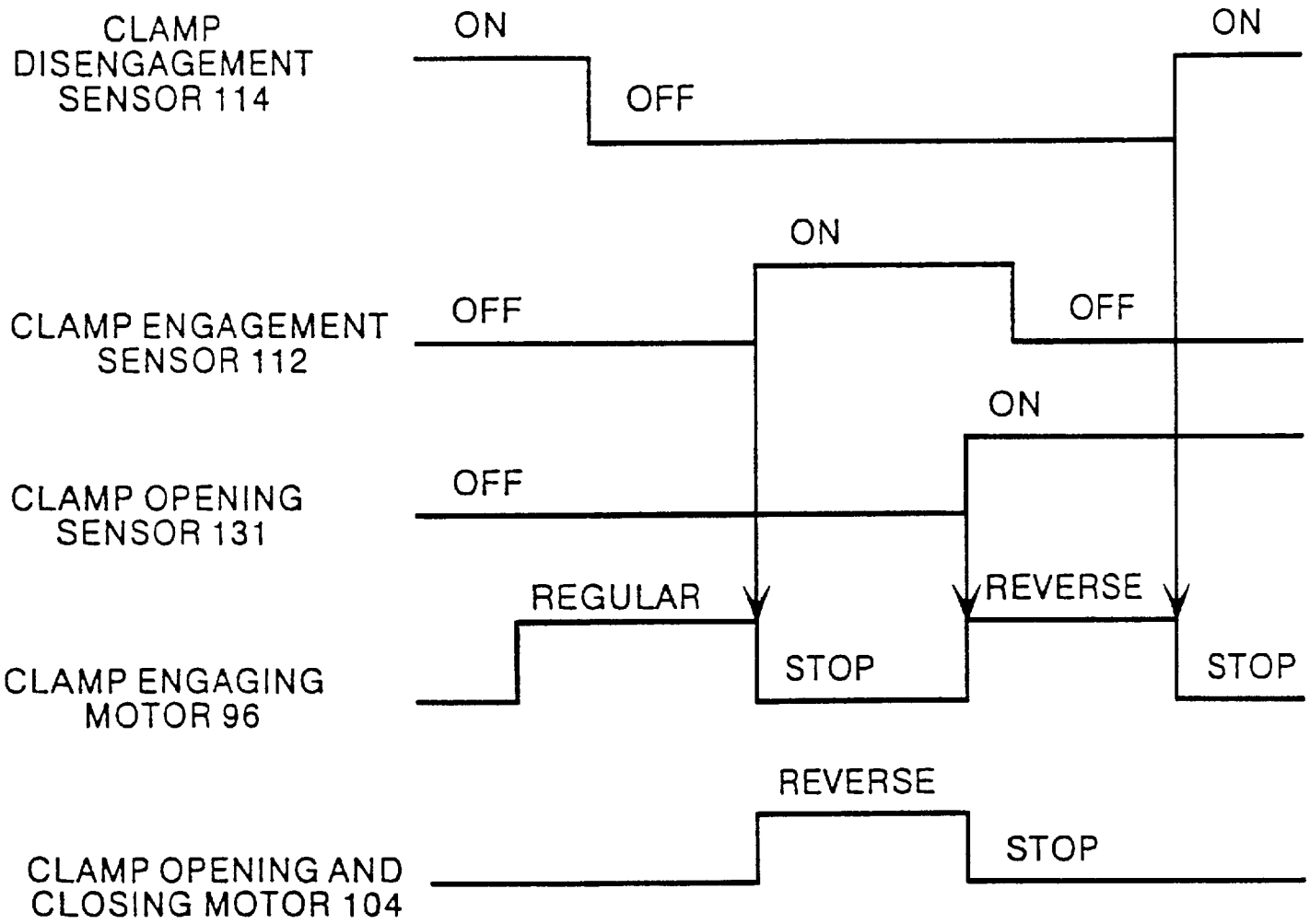
FIG. 18 is a timing chart for the clamp opening operation.

FIG. 18 is a timing chart for this operation.

Again referring to FIG. 10, after the clamp opening operation, a master discharge operation is executed. That is, the master discharge motor and the first motor 54 are driven (SP37, SP38) to rotate the master discharge rollers 36 and 38 and the printing drum 2, whereby the master on the printing drum 2 is peeled off the drum 2 and is conveyed toward the master discharge section.

In one rotation of the printing drum 2, the master is entirely transferred to the master discharge section. Accordingly, when the drum position sensor 92 is turned on (SP40:YES) after once turned off (SP39:YES), the first motor 54 is stopped (SP41) and the master discharge motor is stopped (SP42).

Then after the printing drum 2 stops, the drum position adjustment operation is executed (SP43) in the manner described above in conjunction with FIG. 14.

After the printing drum 2 is positioned accurately in the reference position by the drum position adjustment operation, the master made by the master making section is fed to the clamping position (SP44).

Figure 19:
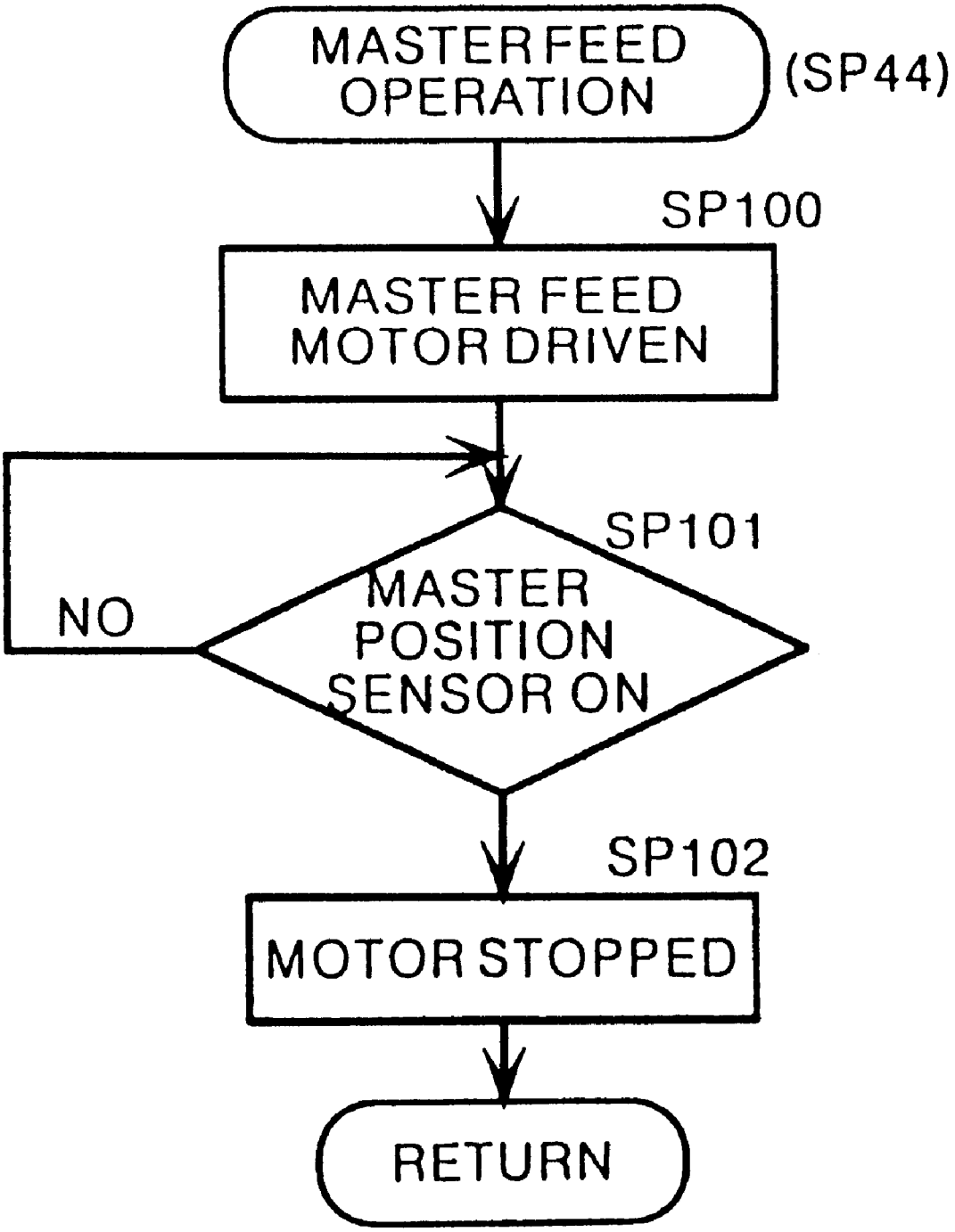
FIG. 19 is a flow chart for illustrating the master feed operation.

The master feed operation will be described with reference to FIG. 19, hereinbelow.

The master feed motor is driven to rotate the master feed rollers 26 and 28 (SP100). When the leading end of the master reaches the clamping position (the state shown in FIG. 4) and the master position sensor 132 is turned on (SP101:YES), the master feed motor is stopped to stop the master feed rollers 26 and 28 (SP102).

After the master feed operation, the clamp drive shaft initialization operation is executed (SP45) in the manner described above in conjunction with FIG. 16.

Figure 20:
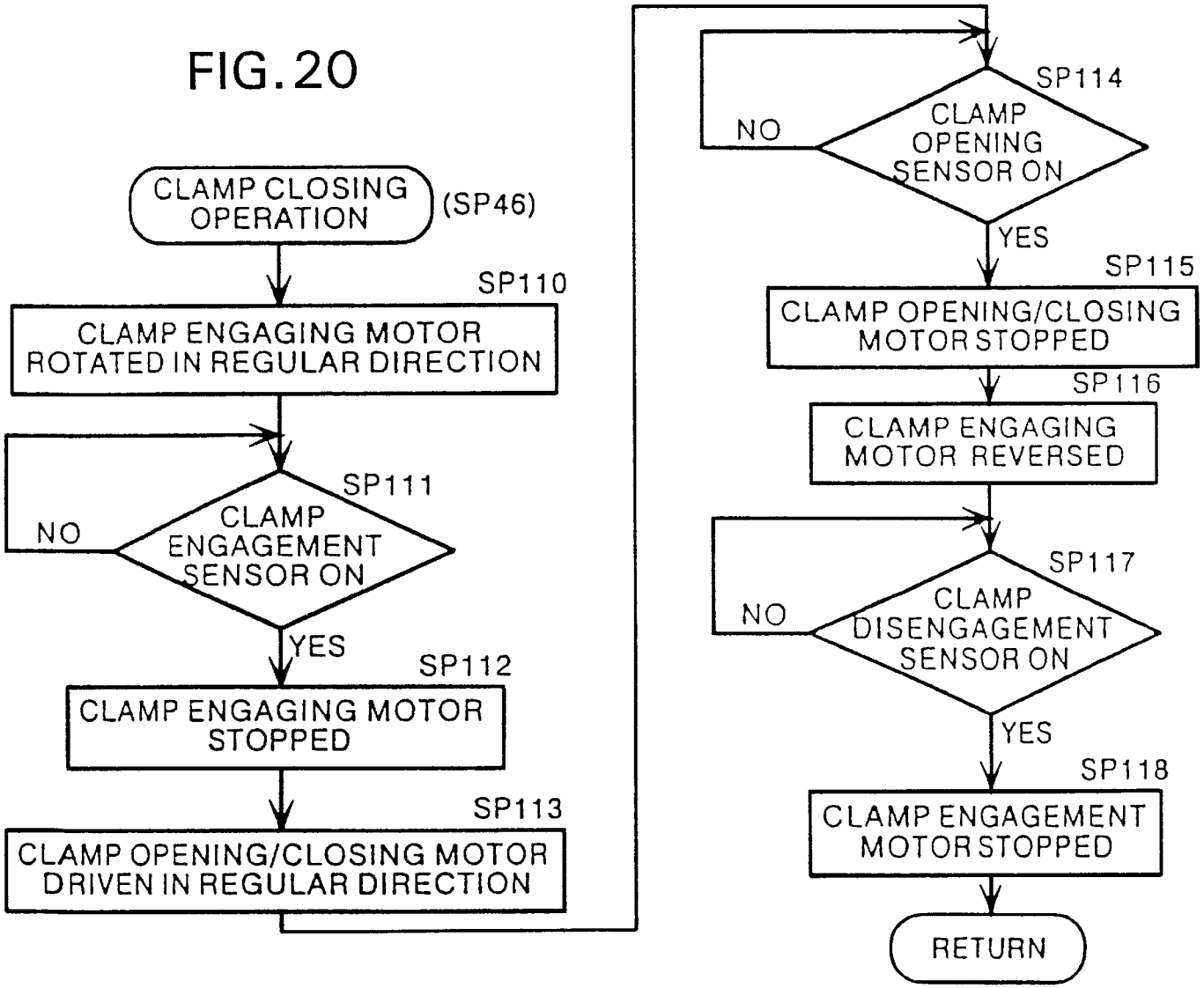
FIG. 20 is a flow chart for illustrating the clamp closing operation.

Then a clamp closing operation for clamping the leading end portion of the master by the clamp plate 2*a* on the printing drum 2 is executed (SP46). The clamp closing operation will be described with reference to FIG. 20, hereinbelow.

The clamp engaging motor 96 is rotated in the regular direction to move the clamp unit 95 toward the printing drum 2, thereby brining the clamp drive shaft 108 into engagement with the joint portion 2*c* of the clamp plate 2*a* (SP100). When the clamp engagement sensor 112 is turned on (SP111:YES), the clamp engaging motor 96 is stopped (SP112).

Then the clamp opening and closing motor 104 is rotated in the regular direction, thereby closing the clamp plate 2*a* (SP113). When the clamp closing sensor 130 is turned on (SP114:YES), the clamp opening and closing motor 104 is stopped (SP115). Thereafter the clamp engaging motor 96 is reversed to move the clamp unit 95 away from the printing drum 2 (SP116). Then when the clamp disengagement sensor 114 is turned on (SP117:YES), the clamp engaging motor 96 is stopped (SP118). Thus this operation is ended.

Figure 21:
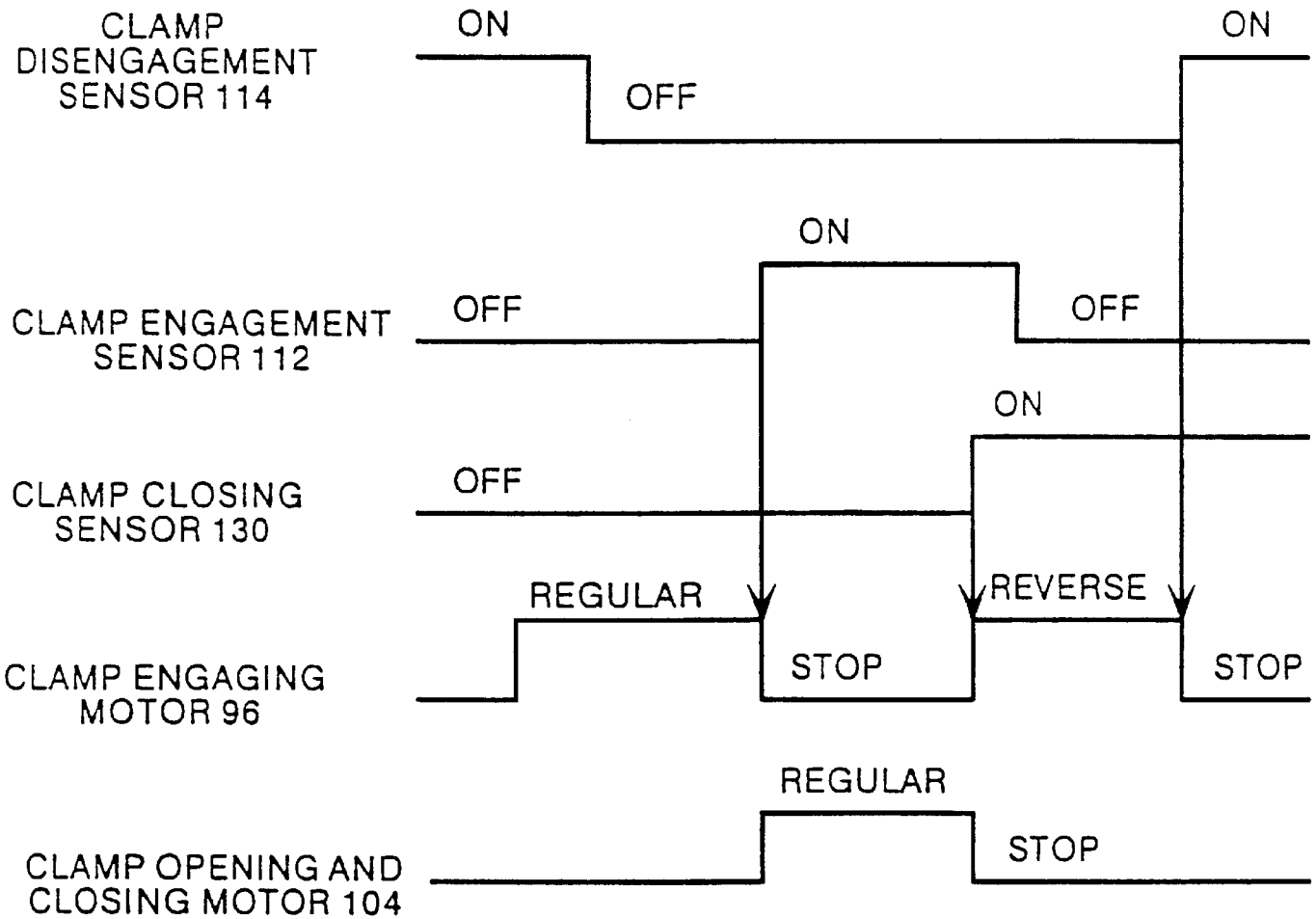
FIG. 21 is a timing chart for the clamp closing operation.

In this manner the leading end portion of the master is fixed to the printing drum 2 by the clamp plate 2*a*. FIG. 21 shows the timing chart for this operation.

Thereafter the master is wrapped around the printing drum 2.

For this purpose, the first motor 54 is driven (SP47). In one rotation of the printing drum 2, the master is entirely wrapped around the printing drum 2. Accordingly, when the drum position sensor 92 is turned on (SP49:YES) after once turned off (SP48:YES), the first motor 54 is stopped (SP50).

Figure 22:
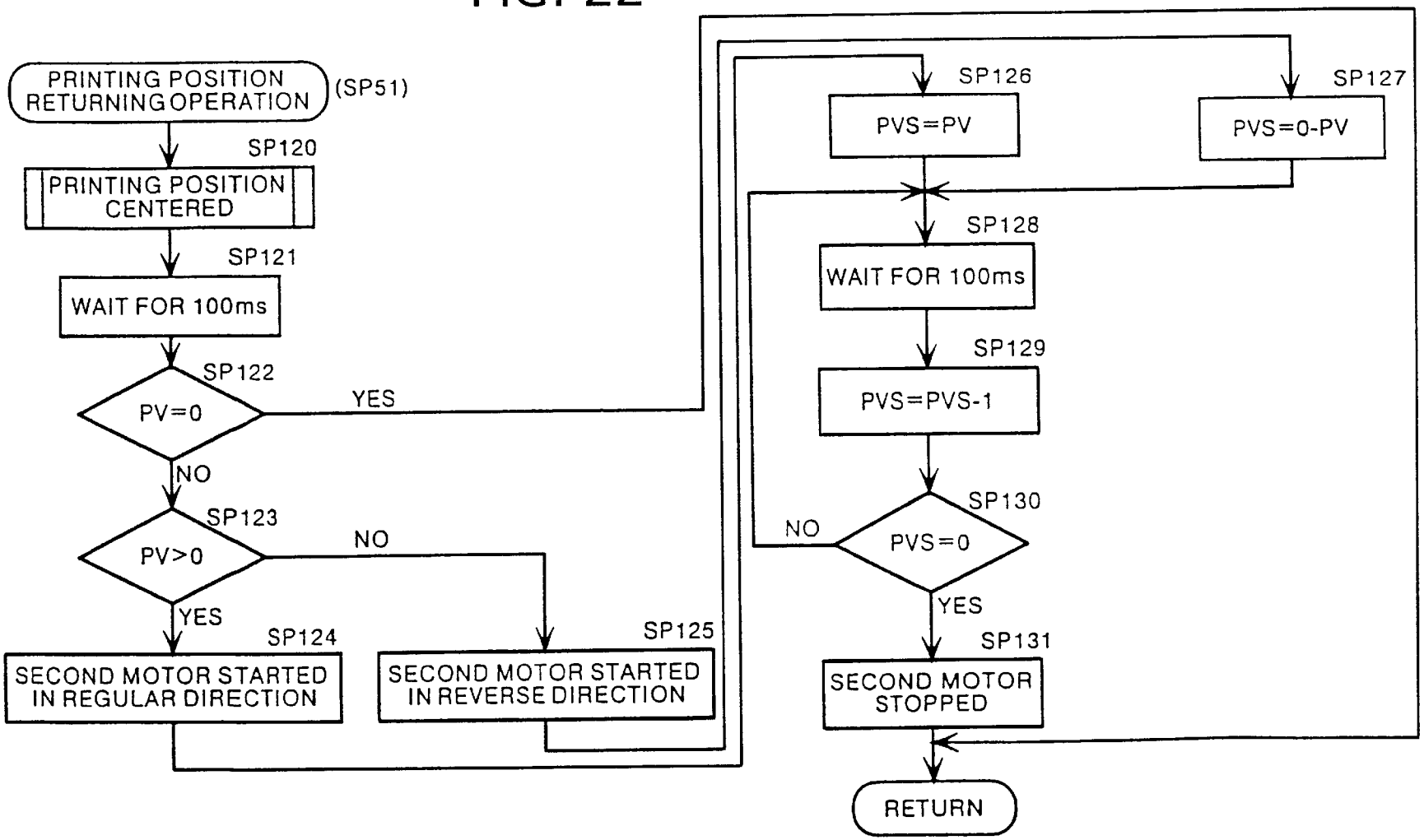
FIG. 22 is a flow chart for illustrating the printing position returning operation.

After the master is thus wrapped around the printing drum 2, a printing position returning operation is executed (SP51). The printing position returning operation is for returning the relative phases of the printing drum 2 and the back-up roller 8 which have been shifted, from those resulting in a printing position set by the operator, during the printing position adjustment operation to those resulting in the printing position set by the operator. The printing position returning operation will be described with reference to FIG. 22, hereinbelow.

First the printing position is returned to the regular position (SP120) in the manner described above in conjunction with FIG. 12.

After the printing position is returned to the regular position, the control means waits for 100 ms (SP121) in order to cancel the influence of inertia. Then if the printing position set by the operator is the regular position, i.e., the center, that is, if the printing position variable PV is 0 (SP122:YES), this operation is ended.

If the printing position variable PV is larger than 0 (SP123:YES), that is, if the printing position is to be shifted upward, the second motor 88 is rotated in the regular direction (SP124).

If the printing position variable PV is smaller than 0 (SP123:NO), that is, if the printing position is to be shifted downward, the second motor 88 is rotated in the reverse direction (SP125). The absolute value of the printing position variable PV is input as a printing position shift variable PVS (SP126, SP127). The printing position shift variable PVS is decremented by one every 100 ms (SP128, SP129), and when the printing position shift variable PVS becomes 0 (SP130:YES), which represents that the printing position is returned to that set by the operator, the second motor 88 is stopped (SP131). Thus this operation is ended.

Figure 23A:
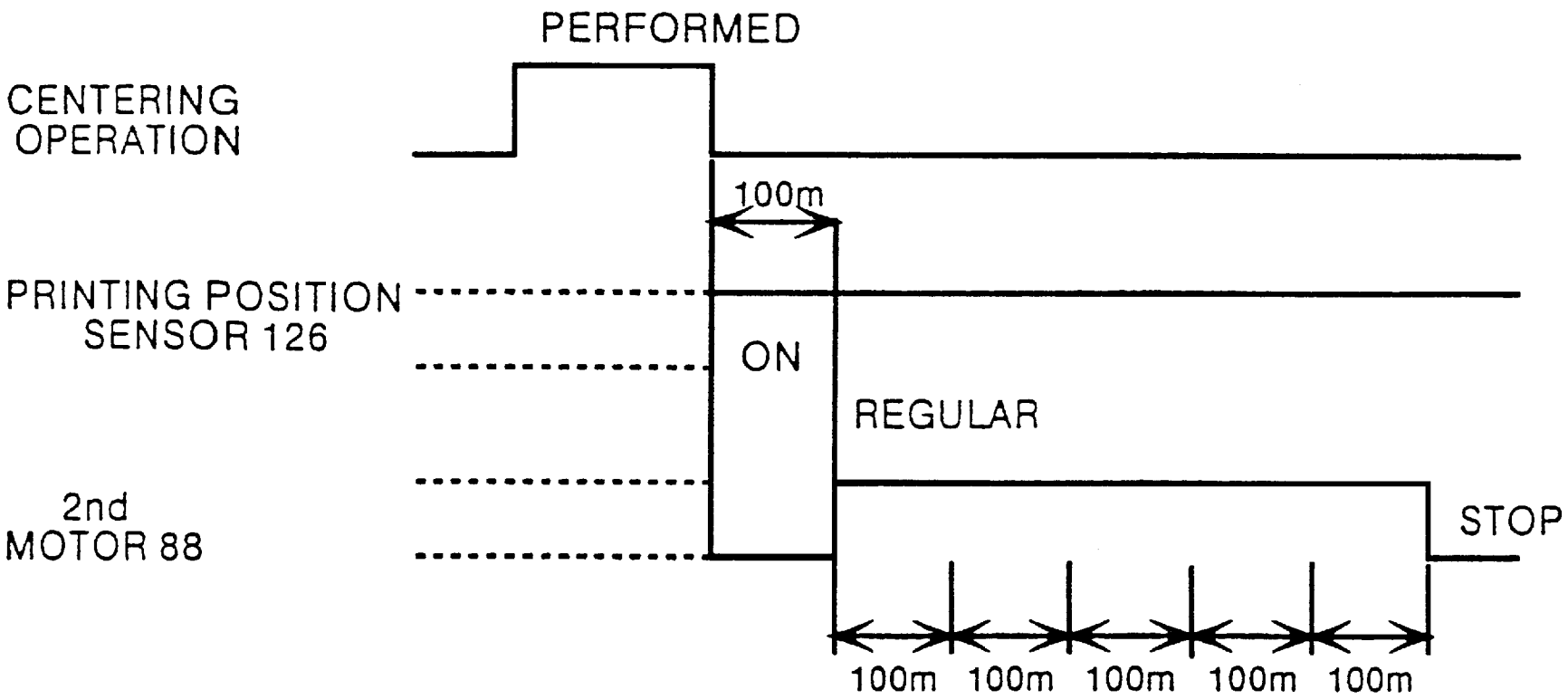
FIGS. 23A and 23B are timing charts for the printing position returning operation.
Figure 23B:
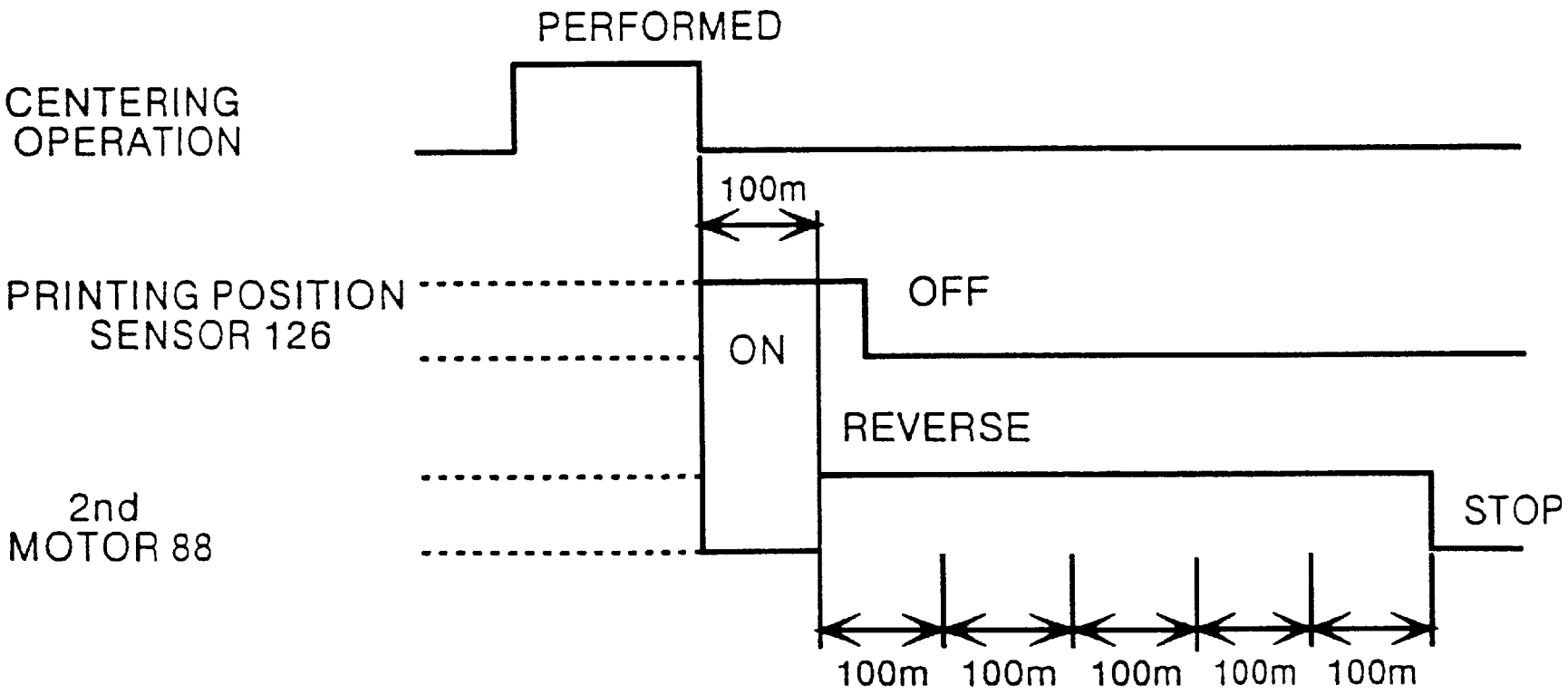

FIG. 23A shows the timing chart for the printing position returning operation when the printing position set by the operator is shifted upward by 0.5 mm from the regular position, and FIG. 23B shows the timing chart for the printing position returning operation when the printing position set by the operator is shifted downward by 0.5 mm from the regular position.

Finally printing is performed (SP52).

Figure 11:
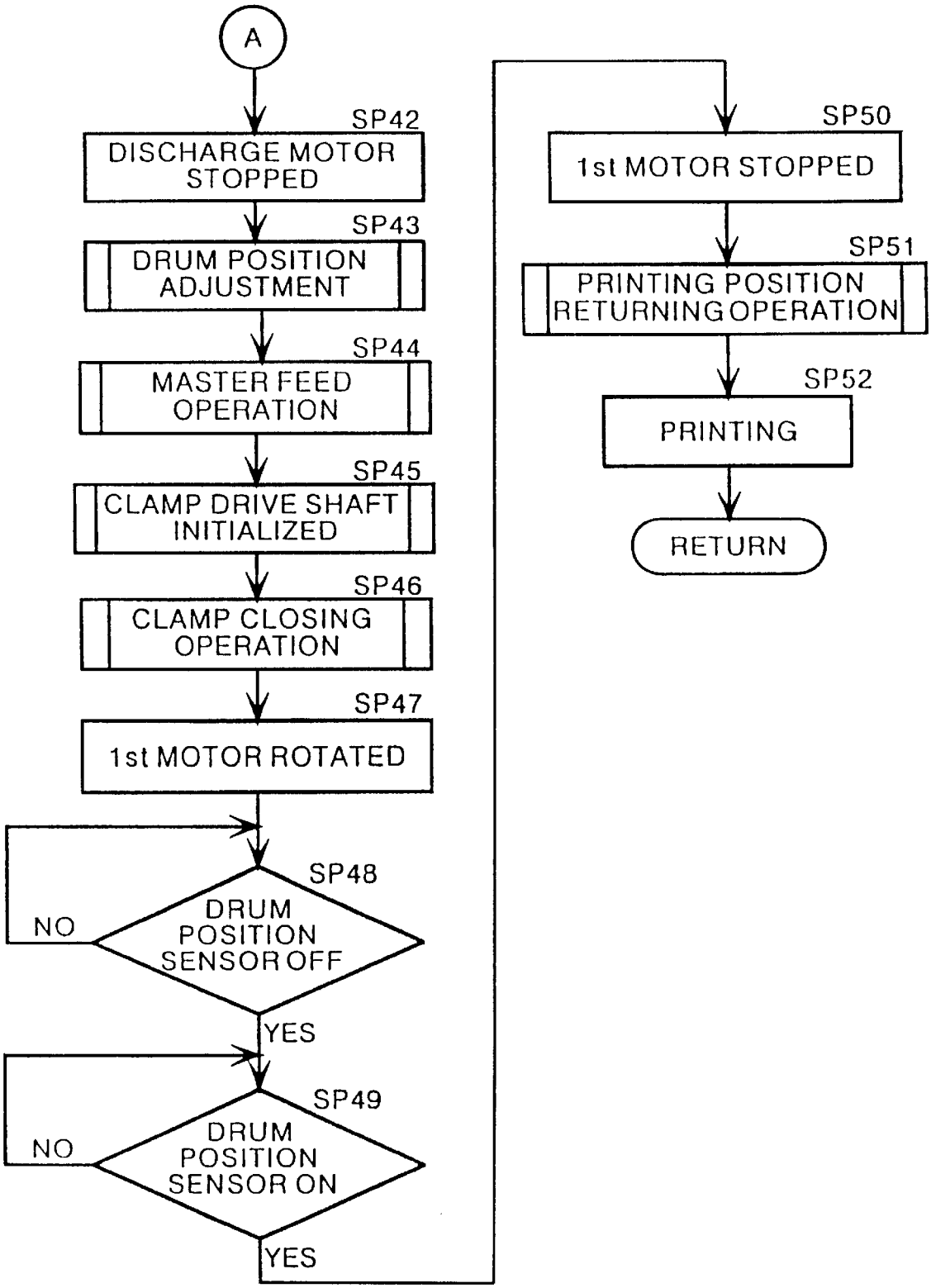
Figure 24:
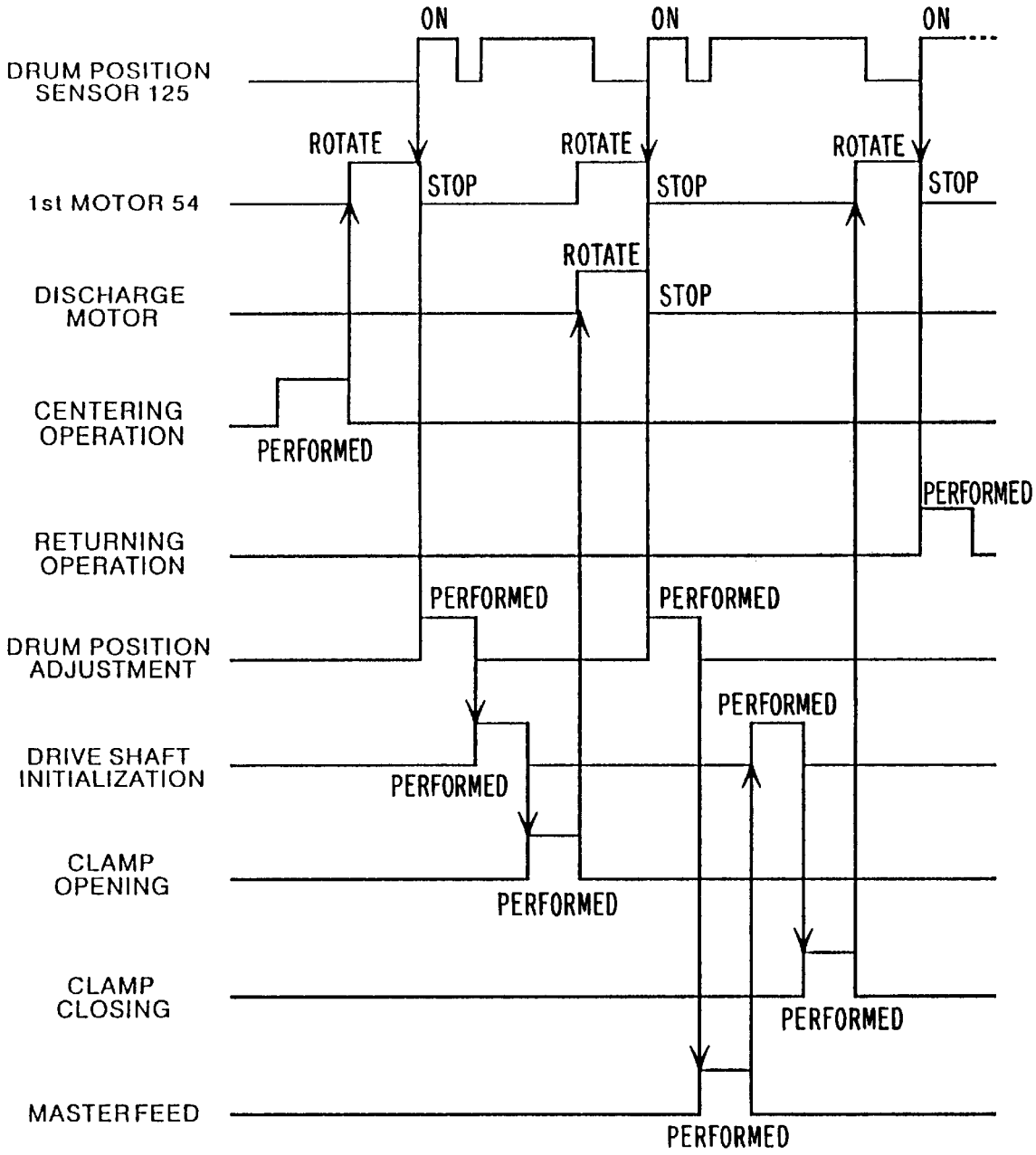
FIG. 24 is a timing chart for the plate making operation.

FIG. 24 shows the timing chart for the process shown in FIGS. 10 and 11.

In the stencil printer of this embodiment, since the second motor 88 can rotate the printing drum 2 at a very low speed, the printing drum 2 can be accurately stopped in the reference position, whereby the stencil master can be wrapped around the printing drum 2 in place and shift of the printing position on the printed sheet can be prevented.

Further by carrying out the drum position adjustment operation before discharging the used master (the position to be stopped for wrapping the master is the same as that for discharging the used master), the master discharge operation can be performed with a high reliability. Further since the printing drum 2 is precisely located when wrapping the master by the drum position adjustment operation, the clamp unit 95 can be surely engaged with the clamp plate 2*a* without interference between the printing drum 2 and the clamp unit 95.

Further since the position of the printing drum is adjusted by use of the motor for driving the phase adjustment means, which the stencil printer is generally provided with, the printing drum 2 can be accurately positioned in the reference position without adding an additional element.

What is claimed is:

1. A stencil printer comprising a printing drum which is supported for rotation about its longitudinal axis and is provided with a clamp means for clamping an end portion of a stencil master, thereby holding the stencil master on the printing drum, a paper supply means which supplies printing sheets to the printing drum in synchronization with rotation of the printing drum, a first motor which drives the paper supply means by way of a first transmission mechanism, a second transmission mechanism which is operatively connected to the first transmission mechanism to be driven by the first motor by way of the first transmission mechanism, thereby rotating the printing drum, a phase adjustment means which can drive the second transmission mechanism with the first transmission mechanism held in place, thereby changing the relative phases of rotation of the printing drum and sheet supply operation of the paper supply means, a second motor which drives the phase adjustment means, a master feed means which feeds a stencil mater to a predetermined clamping position in which it is clamped by the clamp means on the printing drum, a drum position sensor which generates a detecting signal upon detection that the printing drum comes to a reference position where the clamp means is in said clamping position, and a control means into which the detecting signal is input from the drum position sensor and which controls the first and second motors, wherein the control means stops the printing drum in said reference position by driving the first motor to rotate the printing drum in one direction, stopping the first motor upon receipt of the detecting signal from the drum position sensor, and driving the second motor to rotate the printing drum to said reference position by way of the second transmission mechanism.

2. A stencil printer as defined in claim 1 in which said control means stops the printing drum in said reference position by driving the first motor to rotate the printing drum in one direction, stopping the first motor upon receipt of the detecting signal from the drum position sensor, driving the second motor to rotate the printing drum in the other direction, stopping the second motor immediately after the drum position sensor stops generating the detecting signal, driving the second motor to rotate the printing drum in said one direction and stopping the second motor upon receipt of the detecting signal from the drum position sensor.

3. A stencil printer as defined in claim 1 in which the control means stops the printing drum in said reference position when a stencil master is to be wrapped around the printing drum.

4. A stencil printer as defined in claim 3 in which the control means stops the printing drum in said reference position by driving the first motor to rotate the printing drum in one direction, stopping the first motor upon receipt of the detecting signal from the drum position sensor, and driving the second motor to rotate the printing drum to said reference position by way of the second transmission mechanism with the paper supply means held stopped and the control means drives the second motor, after the stencil master is wrapped around the printing drum, to return the printing drum to the position where the printing drum was when the control means stopped the first motor.

5. A stencil printer as defined in claim 4 in which the second transmission mechanism is connected to the first transmission mechanism by way of a planetary gears and the paper supply means is held stopped by virtue of detent torque of the first motor.

6. A method of stopping a printing drum in a reference position in a stencil printer comprising a printing drum which is supported for rotation about its longitudinal axis and is provided with a clamp means for clamping an end portion of a stencil master, thereby holding the stencil master on the printing drum, a paper supply means which supplies printing sheets to the printing drum in synchronization with rotation of the printing drum, a first motor which drives the paper supply means by way of a first transmission mechanism, a second transmission mechanism which is operatively connected to the first transmission mechanism to be driven by the first motor by way of the first transmission mechanism, thereby rotating the printing drum, a phase adjustment means which can drive the second transmission mechanism with the first transmission mechanism held in place, thereby changing the relative phases of rotation of the printing drum and sheet supply operation of the paper supply means, a second motor which drives the phase adjustment means, a master feed means which feeds a stencil master to a predetermined clamping position in which it is clamped by the clamp means on the printing drum, a drum position sensor which generates a detecting signal upon detection that the printing drum comes to a reference position where the clamp means is in said clamping position, and a control means into which the detecting signal is input from the drum position sensor which controls the first and second motors, said method comprising the steps of driving the first motor to rotate the printing drum in one direction, stopping the first motor upon receipt of the detecting signal from the drum position sensor, and driving the second motor to rotate the printing drum to said reference position by way of the second transmission mechanism.

* * * * *